US011680770B2

(12) United States Patent
Buys

(10) Patent No.: US 11,680,770 B2
(45) Date of Patent: Jun. 20, 2023

(54) PNEUMATIC ARRANGEMENT OF A LESS-LETHAL DEVICE

(71) Applicant: BYRNA TECHNOLOGIES, INC., Andover, MA (US)

(72) Inventor: André Johann Buys, Pretoria (ZA)

(73) Assignee: Byrna Technologies, Inc., Andover, MA (US)

( * ) Notice: Subject to any disclaimer, the term of this patent is extended or adjusted under 35 U.S.C. 154(b) by 43 days.

(21) Appl. No.: 17/288,359

(22) PCT Filed: Oct. 24, 2019

(86) PCT No.: PCT/IB2019/059104
§ 371 (c)(1),
(2) Date: Apr. 23, 2021

(87) PCT Pub. No.: WO2020/084547
PCT Pub. Date: Apr. 30, 2020

(65) Prior Publication Data

US 2021/0381797 A1 Dec. 9, 2021

Related U.S. Application Data

(60) Provisional application No. 62/749,895, filed on Oct. 24, 2018.

(51) Int. Cl.
*F41B 11/00* (2013.01)
*F41B 11/62* (2013.01)
(Continued)

(52) U.S. Cl.
CPC ..... *F41B 11/62* (2013.01); *F41B 11/723* (2013.01); *F41B 11/73* (2013.01)

(58) Field of Classification Search
CPC ..... F41B 11/55; F41B 11/62; F41B 11/723; F41B 11/721; F41B 11/50; F41B 11/73;
(Continued)

(56) References Cited

U.S. PATENT DOCUMENTS 3,000,371 A * 9/1961 Hyde ..... F41B 11/62 124/75
3,045,659 A * 7/1962 Malcolm ..... F41B 11/83 43/6

(Continued)

FOREIGN PATENT DOCUMENTS

CA 1080067 6/1960
JP 2006284139 10/2006

*Primary Examiner* — Michael D David
(74) *Attorney, Agent, or Firm* — Simpson & Simpson, PLLC

(57) ABSTRACT

A puncture mechanism that is configured to puncture a seal provided over a mouth of a canister of compressed gas received within a less-lethal device to propel a projectile from the less-lethal device when a trigger mechanism of the less-lethal device is actuated by a user. The puncture mechanism includes a displaceable body that has a piercing mechanism which is configured to pierce the seal provided over a mouth of the canister. The puncture mechanism further includes an actuation arrangement, which comprises a trigger mechanism, for displacing the displaceable body towards the canister whereby the piercing mechanism pierces a seal of the canister and compressed gas flows into a barrel of the less-lethal device to propel the projectile from the less-lethal device.

13 Claims, 15 Drawing Sheets

(51) Int. Cl.
*F41B 11/723* (2013.01)
*F41B 11/73* (2013.01)

(58) Field of Classification Search
CPC ..... F41A 9/69; F41A 9/70; F41A 9/68; F41A 9/65; F41A 9/71
USPC ..... 42/50, 49.01, 7, 49.02, 6; 124/73–77
See application file for complete search history.

(56) References Cited

U.S. PATENT DOCUMENTS 3,048,159 A * 8/1962 Kline ..... F41B 11/62 124/40
3,077,875 A * 2/1963 Kline ..... F41B 11/62 124/76
3,084,833 A * 4/1963 Kline ..... F41B 11/62 222/509
3,127,885 A * 4/1964 Kline ..... F41B 11/62 124/76
3,207,143 A * 9/1965 Kline ..... F41B 11/62 124/40
3,236,224 A 2/1966 Pitcher
3,999,534 A * 12/1976 Chapin ..... F41B 11/62 124/49
4,083,349 A * 4/1978 Clifford ..... F41B 11/52 124/53.5
4,150,656 A * 4/1979 Curran ..... F41B 11/62 141/19
4,344,410 A * 8/1982 Curran ..... F41B 11/62 124/80
5,054,464 A * 10/1991 Young ..... F41B 11/62 124/72
5,165,383 A * 11/1992 Ebert ..... F41B 11/51 124/40
5,341,790 A * 8/1994 Ebert ..... F41B 11/62 124/73
5,363,834 A * 11/1994 Stuchlik ..... F41B 11/723 124/76
5,462,042 A * 10/1995 Greenwell ..... F41B 11/62 124/71
5,622,160 A * 4/1997 Casas Salva ..... F41B 11/54 124/59
5,706,795 A 1/1998 Gerwig
5,711,286 A * 1/1998 Petrosyan ..... F41B 11/55 124/76
5,832,911 A * 11/1998 Mayville ..... F41C 7/00 124/53.5
6,142,058 A * 11/2000 Mayville ..... F41B 11/723 89/126
6,247,995 B1 * 6/2001 Bryan ..... B05B 7/2472 435/189
6,314,954 B1 11/2001 Wang
7,640,927 B1 * 1/2010 Broersma ..... F41B 11/62 124/80
7,752,974 B2 * 7/2010 Wenaas ..... F42B 12/46 222/394
7,845,532 B2 * 12/2010 Burke ..... B25C 1/047 227/8
8,469,015 B2 * 6/2013 Gerwig ..... F41B 11/62 124/57
10,184,751 B2 * 1/2019 Maeda ..... F41B 11/73
2002/0139362 A1 * 10/2002 Shipachev ..... F41A 9/76 124/74
2006/0027223 A1 2/2006 Vasel
2007/0062507 A1 * 3/2007 Broersma ..... F41B 11/52 124/70
2007/0062510 A1 * 3/2007 Broersma ..... F41B 11/62 124/74
2010/0252014 A1 * 10/2010 Tippmann, Jr. ..... F41B 11/51 124/73
2011/0120437 A1 5/2011 Tippmann, Jr.
2013/0192578 A1 8/2013 Maeda
2015/0007804 A1 * 1/2015 Tippmann, Jr. ..... F41B 11/70 124/73
2015/0253101 A1 * 9/2015 Scarr ..... F41B 11/73 124/73

* cited by examiner

PNEUMATIC ARRANGEMENT OF A LESS-LETHAL DEVICE

INTRODUCTION AND BACKGROUND

This invention relates to a less-lethal device. More particularly, the invention relates to a pneumatic arrangement of a less-lethal device, which pneumatic arrangement comprises a puncture mechanism used for puncturing a sealed mouth of a canister of compressed gas, in use received within a body of the less-lethal device; a pressure sensitive activation assembly used to inhibit the device from propelling a projectile therefrom before a predetermined pressure is reached within a release valve of the device; a release valve assembly for venting compressed gas to a barrel to propel the projectile from the device; and a propelling assembly for adjusting the kinetic force with which a hammer impacts a release valve of the device. The invention also relates to a method of propelling a projectile from a less-lethal device.

The use of lethal force by law enforcement agencies or personnel, private security companies, or even private citizens as defensive or self-defensive measures is generally met with dissent. Internationally, legislative and regulatory requirements generally tend to dissuade the use of lethal force, and instead tends towards defensive regimes in the less-lethal sphere.

For example, currently in the USA, proposed legislative changes seek to require law enforcement personnel to employ less-lethal force to incapacitate an attacker, before resorting to lethal force.

In most cases, the effective range or accuracy of known or currently available less-lethal devices render these devices ineffective. Best known examples include tasers and lachrymatory substances such as mace (also known as pepper spray). Tasers are accurate and effective to a maximum of 15 feet. This falls within the currently permissible "shoot to kill" range of 21 feet. Consequently, the current less-lethal devices' inefficiency, inaccuracy and in-utility seem to render adherence to the proposed legislative provisions impractical. In some cases, the use of tasers are viewed as excessive use of force, and annually, as many as a thousand "wrongful deaths" are attributable to the use of tasers in a failed attempt to use less-lethal force by law enforcement agencies.

Also available are launchers (similar to paintball guns) shooting frangible projectiles filled with a lachrymatory substance. Even though these devices have increased ranges, they remain notoriously inaccurate, especially due to manufacturing imperfections and instability of the projectiles. These launchers are furthermore bulky and ergonomically unfriendly when carried on the person or when being handled.

One way to improve the accuracy of projectiles, is to impart spin to the projectile as it is launched. This is achieved by utilising launchers comprising rifled barrels. However, the use of rifled barrels usually falls within the purview of legislative provisions or bodies, such as the ATF (The Bureau of Alcohol, Tobacco, Firearms and Explosives).

A need exists for a less-lethal device, capable of temporarily incapacitating a person effectively at a range exceeding that of currently available less-lethal devices. A need furthermore exists for a compact and ergonomically friendly less-lethal projectile launcher that does not fall within the purview of legislative provisions or bodies, suitable for use by law enforcement agencies, correctional services, the military and civilians alike.

Known less-lethal devices, such as less-lethal pistols comprise a body with a grip portion, a barrel, a canister of compressed gas and a valve assembly arranged to vent gas to propel a projectile received within the barrel upon actuation by a firing mechanism (or trigger).

In a bid to reduce the overall size of the less-lethal device, the canister, which comprises a sealed mouth, is received within the body, and a puncture mechanism is provided for puncturing the sealed mouth, to allow compressed gas to flow towards the valve assembly.

Due to leakage of compressed gas, canisters ideally need to be punctured immediately before use. U.S. Pat. No. 8,430,086B2 describes a puncture mechanism comprising a pin which is displaceable towards the canister by a cam surface on the trigger. The piercing pin is actuated each time the trigger is pulled. A seal is created between a body of the canister and the body of the device. U.S. Pat. No. 8,726,895B2 describes a method of launching a projectile, wherein an initial trigger pull causes the piercing pin to puncture the canister, without causing a projectile to be launched, whereafter subsequent trigger pulls launches projectiles.

These devices and methods are impractical. Firstly, since the piercing pin is actuated each time the trigger is pulled, sensitivity in the trigger pull is lost. Also, specifically in emergency or self-defense situations, reaction times are paramount and the launching of the projectile by the first pull of the trigger is essential.

OBJECT OF THE INVENTION

It is an object of the present invention to provide a pneumatic arrangement for a less-lethal device and a method of propelling a projectile from a less-lethal device, with which the applicant believes the aforementioned disadvantages may at least be alleviated or which may provide a useful alternative for the known pneumatic arrangements and methods.

SUMMARY OF THE INVENTION

According to a first aspect of the invention there is provided a puncture mechanism for puncturing a seal provided over a mouth of a canister of compressed gas operatively received within a body of a less-lethal device, the puncture mechanism comprising:

- a housing defining an internal cavity;
- a displaceable body received within the internal cavity, having a piercing mechanism and an internal bore which extends from the piercing mechanism through the displaceable body; and
- an actuation arrangement for displacing the displaceable body from a first position operatively spaced from the canister, to a second position towards the canister, wherein in use, the piercing mechanism pierces the seal when the displaceable body is displaced towards the second position, so that compressed gas flows from the canister through the internal bore.

The displaceable body may be received sealingly within the housing. When the displaceable body is in the second position, a chamber may be defined between an inner surface of the housing and a rear end of the displaceable body, which chamber may be provided in fluid flow communication with the internal bore.

The chamber may furthermore be provided in fluid flow communication with a valve assembly operatively provided to vent a predetermined volume of compressed gas thereby to propel a projectile from a barrel of the device.

The rear end of the displaceable body may be provided with a surface whereupon compressed gas within the chamber may act operatively thereby urging the displaceable body towards the second position.

The displaceable body may be provided with a peripheral seal received within a peripheral groove, the seal for sealing within the housing, thereby to inhibit compressed gas from operatively escaping between the housing and the displaceable body.

According to a first example of the first aspect of the invention, the actuation arrangement may comprise:

an extension member formed on a trigger mechanism of the less-lethal device; and a contact surface formed on the displaceable body, the arrangement being such that when the displaceable body is located in the first position and the trigger mechanism is actuated by a user, the extension member urges against the contact surface thereby to cause the displaceable body to be displaced to the second position, and so that when the trigger mechanism is released by the user, the extension member moves away from the contact surface, so that the displaceable body remains in the second position.

The contact surface may be in the form of a pin or a shoulder formed on the displaceable body. The displaceable member may comprise a slot extending lengthwise therealong, for the extension member to move in freely when the trigger mechanism is actuated and released while the displaceable body is in the second position.

According to a second example of the first aspect of the invention, the actuation arrangement may comprise:

an extension member of a trigger mechanism of the less-lethal device;

an actuation pin received within a slot extending in the displaceable body; and a link member hingedly connected to the extension member and extending to the actuation pin, the arrangement being such that when the displaceable body is located in the first position and the trigger mechanism is actuated by a user, the link member urges the actuation pin against a front end of the slot thereby to cause the displaceable body to be displaced to the second position, and so that when the trigger mechanism is released by the user, the actuation pin moves away from the front end, so that the displaceable body remains in the second position.

According to a third example of the first aspect of the invention, the actuation arrangement may comprise:

an extension member of a trigger mechanism of the less-lethal device; and an actuation pin extending from the extension member into a slot extending in the displaceable body, wherein a size of the slot exceeds a size of the actuation pin, and wherein the arrangement is such that when the displaceable body is located in the first position and the trigger mechanism is actuated by a user, the extension member urges the actuation pin against a front end of the slot thereby to cause the displaceable body to be displaced to the second position, and so that when the trigger mechanism is released by the user, the actuation pin moves away from the front end, so that the displaceable body remains in the second position.

According to a fourth example of the first aspect of the invention, the actuation arrangement may comprise:

at least one radially disposed cam surface formed on a cam body provided with an annular seal for sealing against the mouth of the canister, the cam body defining an axial bore;

at least one interacting cam surface formed on the displaceable body for interacting with the radially disposed cam surface of the cam body, wherein the piercing mechanism projects in the axial bore of the cam body;

a stop member formed on the displaceable body, receivable within an internal slot formed on the housing, so that when the stop member is received within the internal slot, the displaceable body is prevented from articulating relative to the housing;

a catch formation formed on the displaceable body for catching on a release mechanism; and a biasing means for biasing the displaceable body towards the second position.

A second biasing means may be provided for biasing the cam body and the displaceable body away from each other.

A torsion member may be provided for pivoting the displaceable body to a predetermined orientation within the housing.

The release mechanism may be linked to a trigger mechanism of the less-lethal device, so that an initial actuation of the trigger mechanism may cause the release mechanism to release the catch formation, so that the displaceable body may be displaced to the second position by the first biasing means. The catch member may be in the form of a shoulder formed on the displaceable body.

According to a fifth example of the first aspect of the invention, the actuation arrangement may comprise:

a plurality of cogs formed on a trigger mechanism of the less-lethal device;

a rack arranged relative to the displaceable body, the rack comprising a slot which operatively receives a projection projecting from the displaceable body, wherein the rack is arranged to interact with the cogs; and so that, the when the displaceable body is located in the first position and the trigger mechanism is actuated by a user, the plurality of cogs interact with the rack, thereby to urge the displaceable body to the second position, and wherein the projection is displaceable within the slot, so that the displaceable body remains in the second position when the trigger mechanism is released.

In each of the first to fifth examples, the displaceable body may comprise a sealing formation adapted for sealing against the mouth of the canister, whilst the housing may be provided with a receiving formation for operatively receiving the canister.

According an alternative example of the first aspect of the invention, the puncture mechanism may further comprise a sealing body, received within the housing, displaceable between a forward and a rearward position relative to the housing, the sealing body comprising an annular seal which operatively seals against the mouth of the canister. The sealing body may furthermore comprise an internal bore for receiving a leading portion of the displaceable body. The displaceable body may comprise a shoulder for urging the sealing body towards the canister, when the displaceable body is located in the second position. A seal may be provided between the leading portion of the displaceable body and the internal cavity for operatively preventing compressed gas from leaking between the displaceable body and the sealing body.

According to a second aspect of the invention there is provided a pressure sensitive activation assembly, comprising:

a chamber operatively receiving pressurised gas from a source;

a piston received within the chamber, which is displaceable between a first position and a second position within the chamber;

a biasing means arranged to bias the piston towards the first position;

a locking member displaceable between a first configuration, wherein the locking member interacts with a hammer of a release valve to inhibit the hammer from movement towards the release valve, and a second configuration, wherein the locking member does not interact with the hammer to allow the hammer to actuate the release valve, wherein a predetermined pressure within the chamber causes the piston to overcome the bias of the biasing means thereby to move to the piston to the second position, and wherein the locking member is displaced from the first configuration to the second configuration when the piston is displaced from the first position to the second position.

The locking member may have a catch formation for interacting with a shoulder formed on the hammer, so that when the catch formation and the shoulder of the hammer interacts, the hammer is inhibited from pivoting towards the release valve.

The locking member may comprise first and second arms which are off-set at a predetermined angle, so that the locking member may be substantially L-shaped. The locking member may be fixed relative to the release valve via a hinge. The catch formation may be formed on an extremity of the first arm. The second arm may be arranged in sliding contact with a shoulder formed on the piston, so that when the piston is axially displaced from the first to the second positions, the locking member is pivoted about the hinge to thereby move the catch formation away from the shoulder. The piston may comprise a second shoulder for interacting with the second arm when the piston is displaced to the first position, to return the locking member to the first configuration.

The chamber may be in fluid flow communication with a holding chamber of the release valve.

The biasing means may be adjustable to adjust a minimum gas pressure that would cause the piston the overcome the bias.

According to a third aspect of the invention there is provided a release valve assembly for venting a predetermined volume of compressed gas thereby to propel a projectile from a barrel of a less-lethal device, the release valve assembly comprising:

a holding chamber for operatively containing gas at a predetermined pressure, the holding chamber comprising an outlet for gas into the barrel;

a valve pin displaceable between a closed position wherein the outlet is sealed, and an open position, wherein gas is allowed to escape from the holding chamber into the barrel, the valve pin being biased towards the closed position by a biasing means; and a hammer arranged to strike a striking surface when actuated, the arrangement being such that the striking surface, when struck by the hammer, causes the valve pin to move to the open position.

The hammer may be fixed relative to the striking surface by a hinge, and may be displaceable between a cocked position and an un-cocked position. The hammer may be biased towards the un-cocked position by a biasing means. The hammer may comprise a cocking shoulder with a catch mechanism for holding the hammer in the cocked position. The biasing means may be a torsion spring, comprising a first and second arm. At rest, the first and second arms may be disposed at a free-angle relative to each other. The hammer may comprise a shoulder. In use, the first arm of the torsion spring may be arranged in contact with the shoulder of the hammer.

A kinetic force with which the striking surface is struck by the hammer may be adjusted, thereby to adjust the volume of gas escaping through the outlet, by means of a tension adjusting mechanism. The tension adjusting mechanism may comprise:

a follower body, defining a shoulder against which the second arm of the torsion spring urges in use; and an adjusting mechanism for adjusting the follower body to cause the first and second arms of the torsion spring to be adjusted angularly relative to each other.

The follower body may be pivotably fixed relative to the body of the device. The adjusting mechanism may comprise an adjusting body slidably received within the body of the device, and displaceable between a first and second position. The adjusting body may comprise a protuberance in the form of a pin extending therefrom, in use received within a slot formed on the follower body, to constitute a linear cam arrangement between the follower body and the adjusting body, so that, when the adjusting body is displaced from the first to the second positions, the first and second arms of the torsion spring is adjusted relative to each other. The adjusting body may comprise a tapped hole. A shank of an adjustment screw may be received within the adjusting body, such that when the adjustment screw is rotated, the adjusting body is displaced between the first and second positions. A head of the adjustment screw may be prevented from being axially displaced relative to the body of the device. A portion of the body of the device proximate the head of the adjustment screw may define an aperture for operatively receiving a head of a screw-driver therethrough.

According to a fourth aspect of the invention there is provided a propelling assembly, comprising a release valve assembly according to the third aspect of the invention and the pressure sensitive activation assembly according to the second aspect of the invention.

According to a fifth aspect of the invention, there is provided a method of propelling a projectile from a barrel of a less-lethal device, comprising the steps of:

inserting a sealed canister of compressed gas into a receiving portion in a body of the less-lethal device;

providing a first trigger pull to a trigger mechanism to cause a displaceable body of a puncture mechanism to move from a first position relative to the canister, to a second position in which a piercing mechanism comprising a bore therethrough pierces a seal of the canister, so that compressed gas flows through the bore to a release valve; and venting a predetermined volume of gas, via the release valve, responsive to the first trigger pull, to the barrel thereby to cause the projectile to be propelled from the barrel.

The method of propelling a projectile from a barrel of a less-lethal device may comprise the further steps of accumulating gas within a holding chamber of the release valve, until a predetermined pressure is reached; and causing a pressure sensitive activation assembly to activate a hammer, which causes the release valve to vent the predetermined volume of gas to the barrel.

BRIEF DESCRIPTION OF THE ACCOMPANYING DRAWINGS

The invention will now further be described, by way of example only, with reference to the accompanying diagrams wherein.

DESCRIPTION OF PREFERRED EMBODIMENTS OF THE INVENTION

Figure 1:
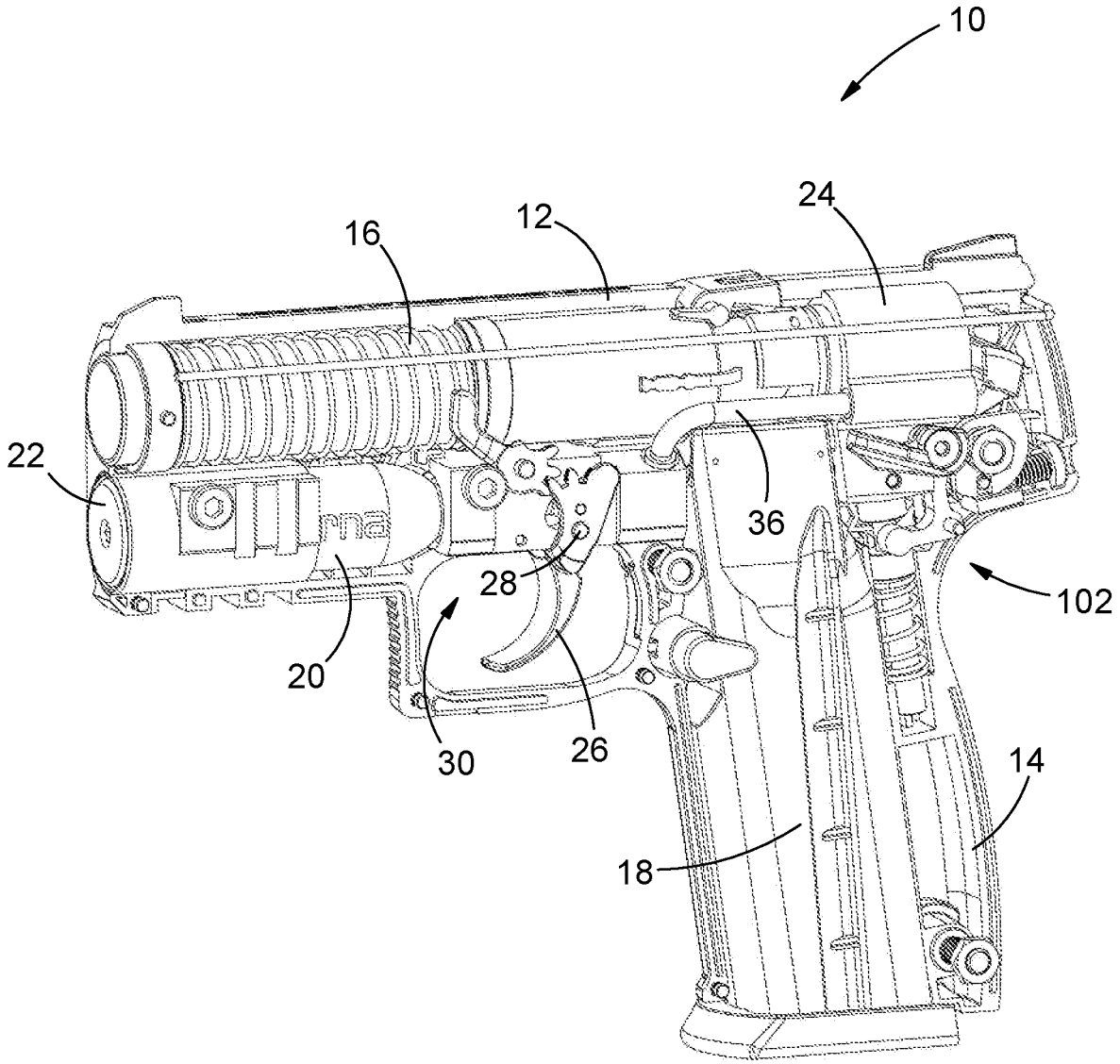
FIG. 1 is a perspective view of an example less-lethal device according to the current invention, from which a body panel has been removed to render the inner components visible.

A less-lethal device, in the form of a less-lethal pistol, is indicated by reference numeral 10 in FIG. 1. The less-lethal device 10 typically comprises a body 12 having a grip portion 14 for handling the device 10 and a barrel 16 through which a projectile (not shown) is propelled in use. A magazine 18 is provided within the grip portion 14 and utilised to house a number of projectiles, and to load projectiles into a breech of the barrel 16. A canister of compressed gas 20 is located within the body 12, and typically, below the barrel 16. The canister 20 is locked in position within the body 12, by a locking cap 22, typically provided with screw-in or a bayonet-type locking mechanism. A release valve 24 is provided to vent a predetermined volume of compressed gas into the barrel 16, thereby to propel the projectile therefrom. The release valve 24 and canister 20 are therefore operatively arranged in fluid-flow communication. The release of gas by the release valve 24 is triggered by a trigger mechanism 26, which hinges about a hinge point 28.

Figure 3:
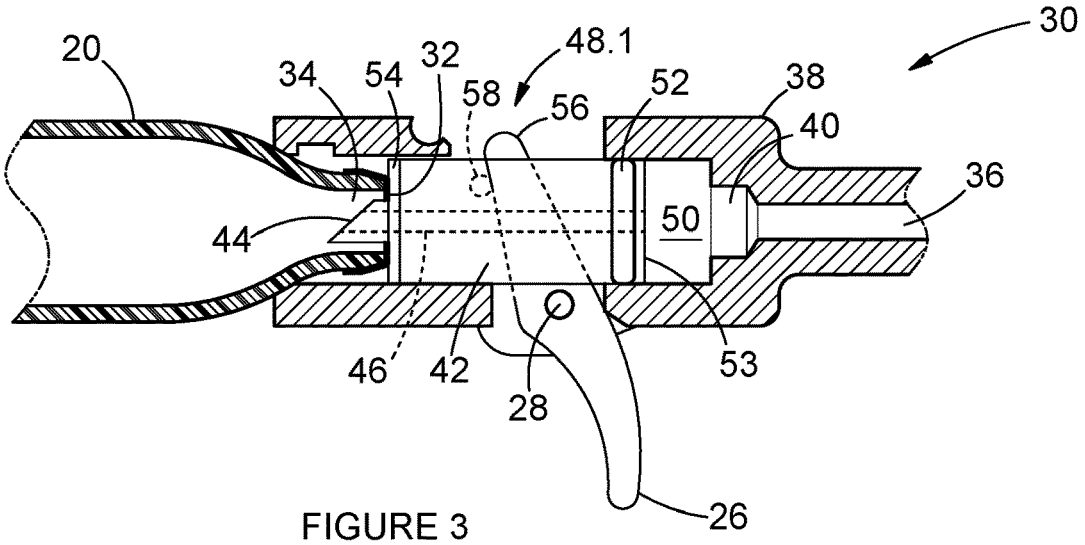
FIG. 3 is the puncture mechanism of FIG. 2, with the displaceable body in a second position, and wherein a trigger mechanism is actuated or pulled by a user.

A puncture mechanism 30 is provided to initially puncture or open a seal 32 provided over a mouth 34 of the canister 20 (typically shown in FIG. 3). The canister 20 (also known as a cartridge) is of the known kind and is typically filled with compressed carbon dioxide ($CO_2$). A pressure tube 36 (shown in FIG. 1) connects the canister 20, via the puncture mechanism 30, to the release valve 24.

It will be understood that the less-lethal device 10 could take various forms other than that of a pistol, and may include such configurations as rifles and the like. In all instances the less-lethal device 10 utilises the release of compressed air to propel a projectile from a barrel. Throughout the remainder of this disclosure, reference will be made to a less-lethal device 10 of the pistol configuration.

The puncture mechanism 30 may take on various forms and configurations, as will be discussed in detail below. Generally, the puncture mechanism 30 comprises a housing 38 (or casing) defining an inner cavity 40. A displaceable body 42 is received within the inner cavity 40, in such a way that it is displaceable axially relative to the housing 38. A piercing mechanism 44 is formed towards an operative front end of the displaceable body 42. The piercing mechanism 44 typically takes the form of a needle or pin having a sharp point. A bore 46 runs from the piercing mechanism 44 through the displaceable body 42. The bore 46 exits into the inner cavity 40.

An actuation arrangement (generally indicated as 48) is provided for operatively displacing the displaceable body 42 from a first position to a second position. When the displaceable body 42 is in the first position, it is spaced axially away from the canister 20 (when the canister is in situ), and the piecing mechanism 44 does not puncture or pierce the seal 32. When the displaceable body 42 is in the second position, it is displaced towards the canister 20 (in situ) so that the piercing mechanism 44 pierces a portion of the seal 32 and at least partially enters through the mouth 34 of the canister 20. The displaceable body 42 is shown in the first position in each of FIGS. 2, 5, 8, 11, 15 and 20 and in the second position in each of FIGS. 3, 4, 6, 7, 9, 10, 14, 16, 17, 22 and 24.

Therefore, when the actuation arrangement 48 causes the displaceable body 42 to be displaced to the second position, the piercing mechanism 44 pierces the seal 32. Also, when the displaceable body 42 is in the second position, a chamber 50 is defined between the housing 38 and a rear end or surface 53 of the displaceable body 42 (the chamber 50 is therefore defined within the inner cavity 40). The bore 46 therefore exits through the rear end or surface 53, so that, when the displaceable body 42 is in the second position, the canister 20 is in fluid-flow communication with the chamber 50, and therefore, compressed gas from the canister 20 flows in the bore 46, through the displaceable body 42 and into the chamber 50. The chamber 50 is provided in fluid flow communication with the release valve 24 via the pressure tube 36.

The displaceable body 42 comprises a groove for receiving a peripheral seal 52 (which may take the form of an O-ring), which creates a fluid-tight seal between the displaceable body 42 and the inner cavity 40, or at least, inhibits gas from escaping between the housing 38 and the displaceable body 42. The rear surface 53 of the displaceable body 42, which is received within the inner cavity 40, acts as a piston or plunger, so that pressure within the chamber 50 acts on the rear surface 53 thereby exerting a resultant force on the displaceable body 42, which urges the displaceable body 42 to the second position. In this way, the displaceable body 42 remains in the second position after initially being displaced from the first position to the second position, at least as long as the chamber 50 remains under a suitable amount of pressure.

In the examples of FIGS. 2 to 10 and 15 to 17, a sealing formation 54 is provided to seal against the mouth 34 of the canister 20 when the displaceable body 42 is in the second position. Here, the sealing formation 54 is formed on the displaceable body 42. As the pressure within the chamber 50 urges the displaceable body 42 towards the second position, the sealing formation 54 is pressed against the mouth 34, thereby creating a tight seal. The locking cap 22 anchors the canister 20 in position and prevents it from being displaced by the force exerted on it by the displaceable body 42. An operative front portion of the housing 38 is adapted to securely receive the canister 20.

Upon the initial puncturing of the seal 32, compressed gas fills the chamber 50 almost instantaneously and the release valve 24 is similarly almost instantaneously provided with compressed gas. As is described in more detail below, the initial pulling of the trigger mechanism 26 causes both the seal 32 to be punctured, the chamber 50 to become pressurised and the release valve 24 to vent a first predetermined volume of compressed gas thereby to propel a projectile from the barrel 16.

Various different embodiments of the actuation arrangement 48 are shown in FIGS. 2 to 17.

Figure 2:
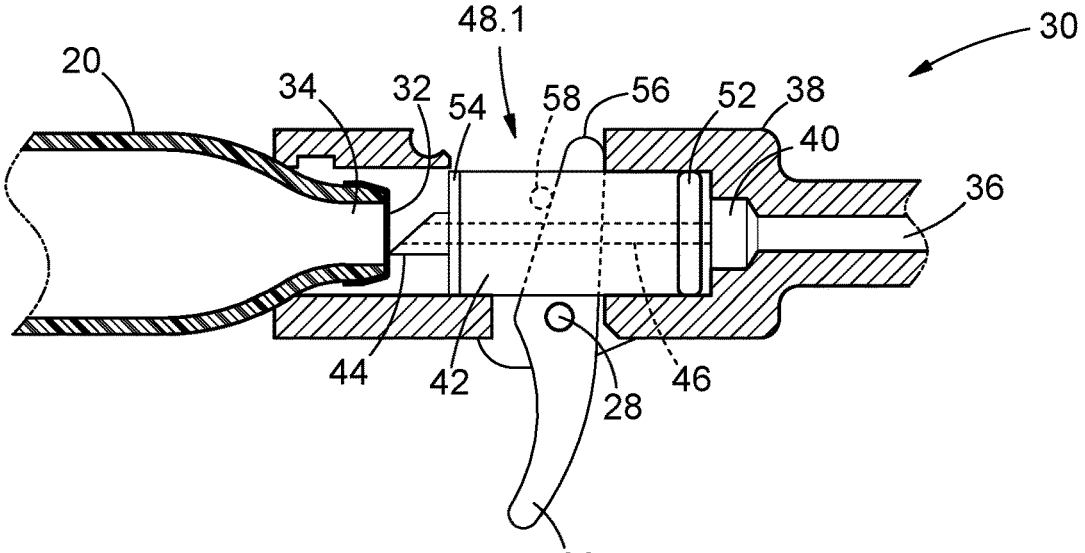
FIG. 2 is a puncture mechanism incorporating a first example embodiment of an actuation arrangement according to the invention, wherein a displaceable body is located in a first position.
Figure 4:
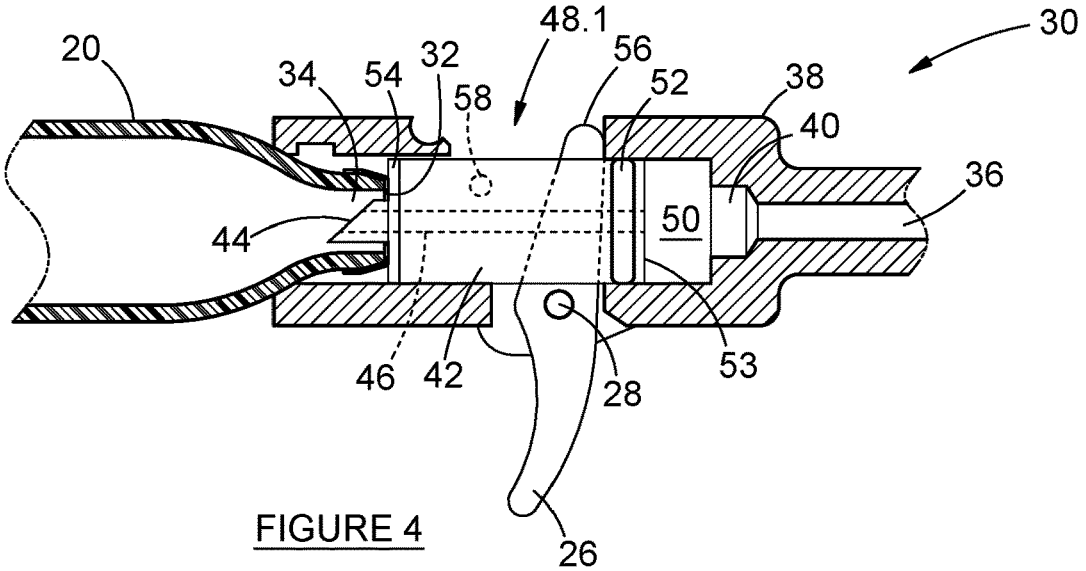
FIG. 4 is the puncture mechanism of FIG. 3 after the trigger has been released.

A first example actuation arrangement 48.1 is shown in FIGS. 2 to 4. Here, the trigger mechanism 26 comprises an extension member 56 while a contact surface 58 is formed on the displaceable body 42. The contact surface is typically in the form of a pin (as shown) or a shoulder (not shown).

Initially the canister 20 is loaded into position within the body 12, and the displaceable body 42 is located in the first position (as is shown in FIG. 2). The seal 32 covering the mouth 34 is therefore intact, and there is no flow of compressed gas through the bore 46. The chamber 50 is therefore at atmospheric pressure. When the trigger mechanism 26 is actuated (or pulled) by a user of the less-lethal device 10, the extension member 56 urges against the contact surface 58. The extension member 56 makes sliding contact with the contact surface 58. The urging of the extension member 56 against the contact surface 58 causes the displaceable body 42 to be displaced to the second position and in the process, the piercing mechanism 44 pierces or breaks the seal 32, so that compressed gas flows into and through the bore 46, and the chamber 50 is pressurised.

Since the extension member 56 and the contact surface 58 are provided in urging contact, the extension member 56 is free to move away from the contact surface 58 when the trigger mechanism 26 is released. Consequently, when the trigger mechanism 26 is released by the user, the displaceable body 42 remains in the second position.

Subsequent trigger mechanism 26 pulls by the user will not cause the displaceable body 42 to be displaced away from the second position. The volume of compressed gas within the canister 20 limits the number of projectiles that can be propelled from the barrel 16. Once the canister 20 is spent, it is removed and replaced by a new sealed canister 20. The above process is thus repeated.

A lengthwise slot (not shown) may be formed in the displaceable member 42 for the extension member 56 to move in freely when the trigger mechanism 26 is actuated and released while the displaceable body 42 is in the second position.

Figure 5:
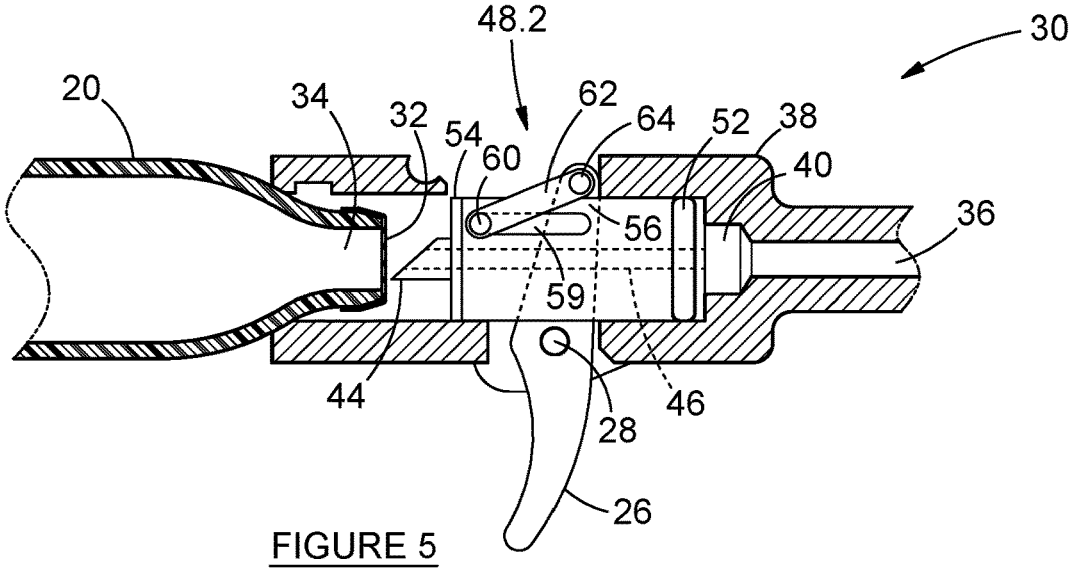
FIG. 5 is a puncture mechanism incorporating a second example embodiment of an actuation arrangement according to the invention, wherein a displaceable body is located in a first position.
Figure 6:
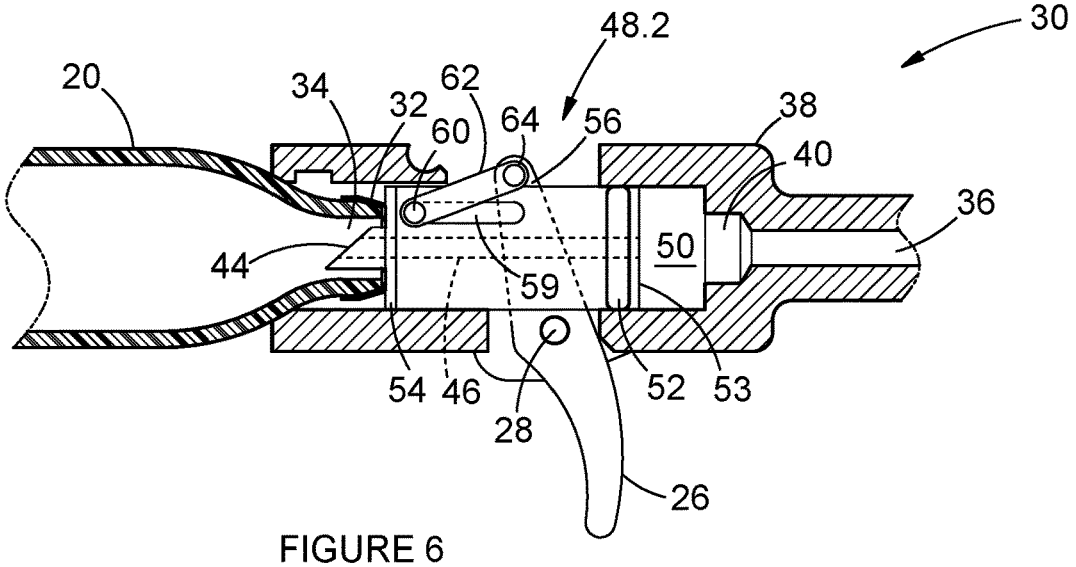
FIG. 6 is the puncture mechanism of FIG. 5, with the displaceable body in a second position, and wherein a trigger mechanism is actuated or pulled by a user.
Figure 7:
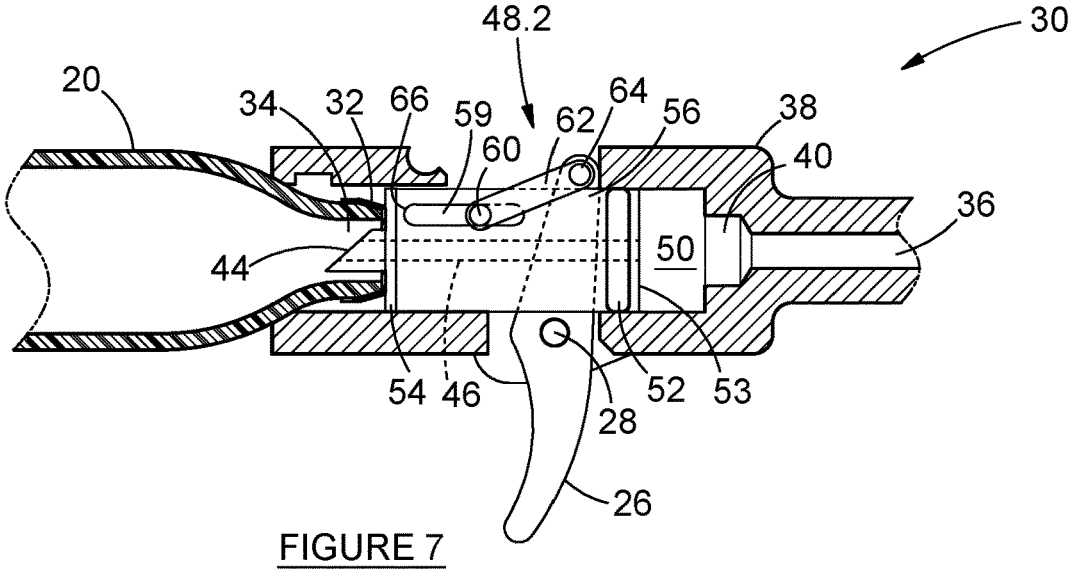
FIG. 7 is the puncture mechanism of FIG. 6 after the trigger has been released.

A second example actuation arrangement 48.2 is shown in FIGS. 5 to 7. Again, the trigger mechanism 26 comprises the extension member 56. The displaceable body 42 comprises a slot 59 that extends lengthwise in the displaceable body 42 (substantially parallel to the bore 46). Typically, the slot 59 extends through the displaceable body 42. An actuation pin 60 is received within and extends through the slot 59. A link member 62, which is hingedly connected to the extension member 56, typically by a hinge 64, links the actuation pin 60 and the extension member 56. The actuation pin 60 is received loosely within the slot 59, so that it is free to slide relative to the slot 59.

The canister 20 is loaded into position as described above and the displaceable body 42 is located in the first position. When the trigger mechanism 26 is actuated, the link member 62 urges the actuation pin 60 against a front end 66 of the slot 59 thereby causing the displaceable body 42 to be displaced to the second position. Again, in the process, the piercing mechanism 44 pierces or breaks the seal 32 so that compressed gas flows into and through the bore 46, thereby pressurising the chamber 50.

Due to the length of the slot 59 and the fact that the actuation pin 60 is free to slide in the slot 59 and move away from the front end 66, the displaceable body 42 remains in the second position when the trigger mechanism 26 is released.

Figure 8:
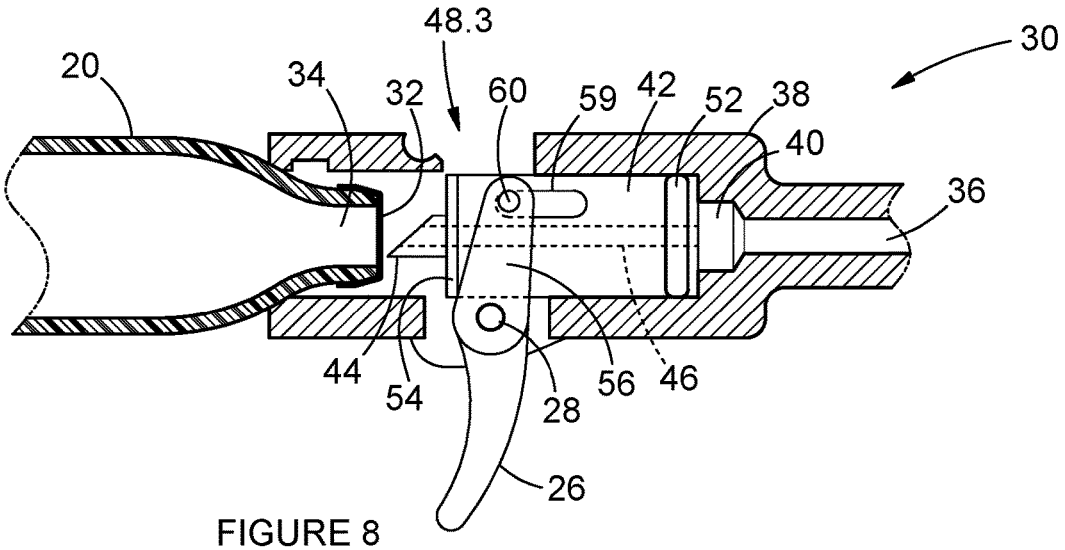
FIG. 8 is a puncture mechanism incorporating a third example embodiment of an actuation arrangement according to the invention, wherein a displaceable body is located in a first position.
Figure 9:
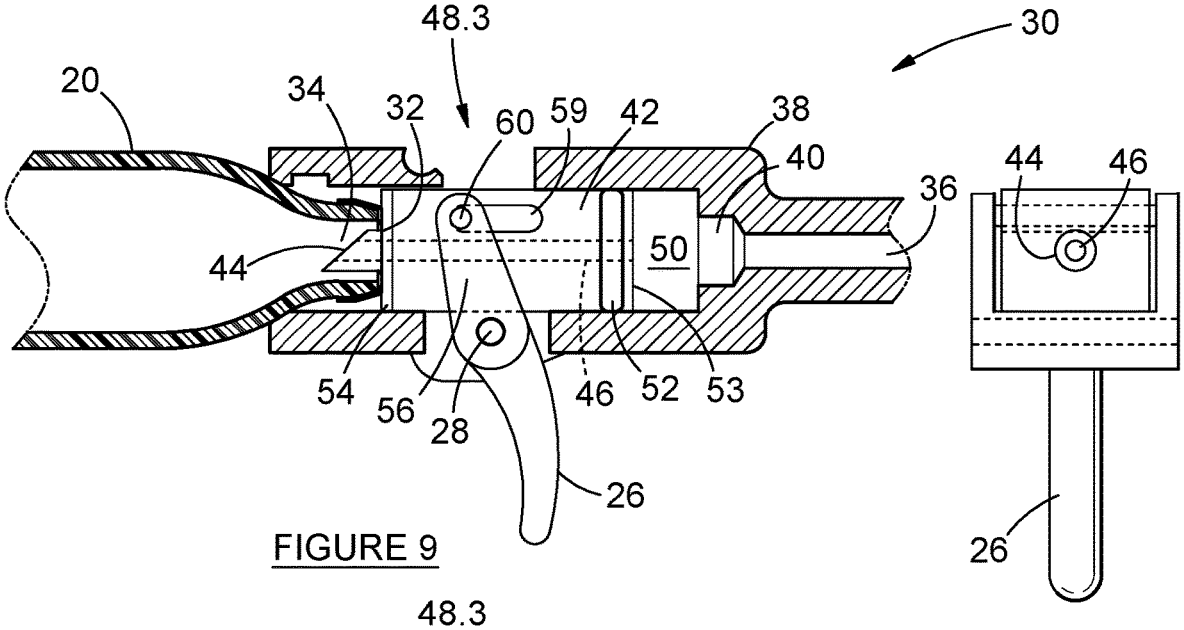
FIG. 9 is the puncture mechanism of FIG. 8, with the displaceable body in a second position, and wherein a trigger mechanism is actuated or pulled by a user.
Figure 10:
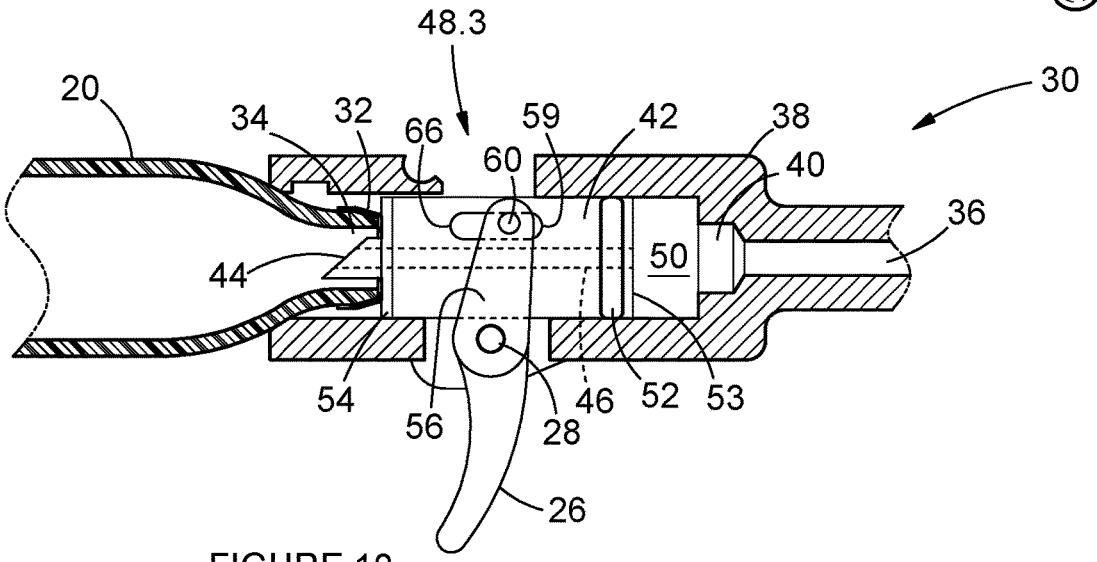
FIG. 10 is the puncture mechanism of FIG. 9 after the trigger has been released.

A third example actuation arrangement 48.3 is shown in FIGS. 8 to 10. Again, the trigger mechanism 26 comprises the extension member 56 and the displaceable body 42 comprises a slot 59 that extends lengthwise in the displaceable body 42 with an actuation pin 60 received within and extending through the slot 59. However, now the actuation pin 60 extends from the extension member 56, directly into the slot 59. When the trigger mechanism 26 is actuated to hinge about the hinge point 28, the actuation pin 60 describes a curve. The slot 59 is now larger, to accommodate the curve described by the actuation pin 60 when the trigger mechanism 26 is actuated.

The canister 20 is loaded into position as described above and the displaceable body 42 is located in the first position. When the trigger mechanism 26 is actuated, the actuation pin 60 again urges against the front end 66 of the slot 59 thereby causing the displaceable body 42 to be displaced to the second position. Again, in the process, the piercing mechanism 44 pierces or breaks the seal 32 so that compressed gas flows into and through the bore 46, thereby pressurising the chamber 50.

Due to the length of the slot 59 and the fact that the actuation pin 60 is free to slide in the slot 59 and move away from the front end 66, the displaceable body 42 remains in the second position when the trigger mechanism 26 is released.

A fourth example actuation arrangement 48.4 is shown in FIGS. 11 to 14. Here the puncture mechanism 30 comprises a second body, in the form of a cam body 68 which defines an axial bore 69 therethrough. The sealing formation 54 is provided on the cam body 68, instead of on the displaceable body 42 as described previously. Therefore, in use, the mouth 34 of the canister 20 presses against the sealing formation 54 and therefore the cam body 68. The piercing mechanism 44 projects in the axial bore 69.

The cam body 68 comprises at least one, but typically as shown, two radially disposed cam surfaces 70. The displaceable body 42 is furthermore provided with opposing and interacting cam surfaces 72 in use arranged to interact with the radially disposed cam surfaces 70.

A stop member 74 is provided on the displaceable body 42, whilst the housing 38 is provided with an internal slot (not shown) that extends substantially longitudinally within the housing 38. The internal slot is provided for receiving the stop member 74. The inner cavity 40, as well as a portion of the displaceable body 42 received within the inner cavity 40, is cylindrical, so that the displaceable body 42 may pivot or rotate relative to the housing 38. However, when the stop member 74 is located within the internal slot, the displaceable body 42 is prevented or inhibited from rotating or pivoting within the housing 38. A first biasing means 76 is provided within the inner cavity 40 and arranged to abut against a rear wall 78 of the chamber and the rear surface 53 of the displaceable body 42.

The displaceable body 42 has a catch formation 80 in the form of a shoulder. A release mechanism 82 is provided for interacting with the catch formation 80. The release mechanism 82 is linked to the trigger mechanism 26.

Figure 11:
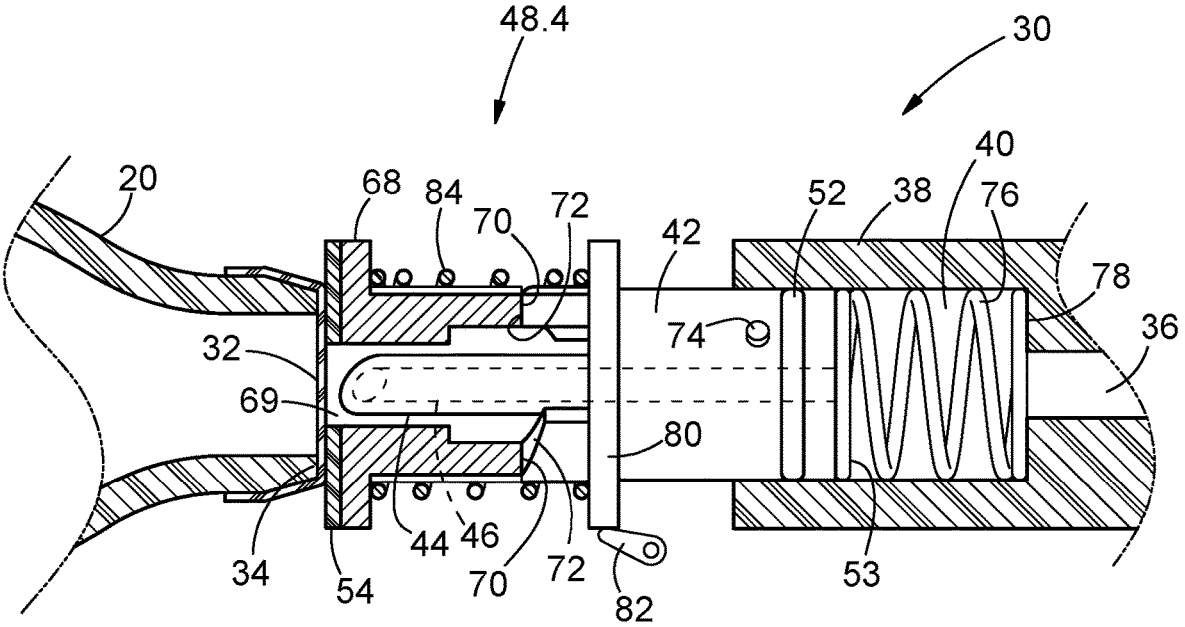
FIG. 11 is a puncture mechanism according to the invention, further including a cam body interacting with the displaceable body.
Figure 12:
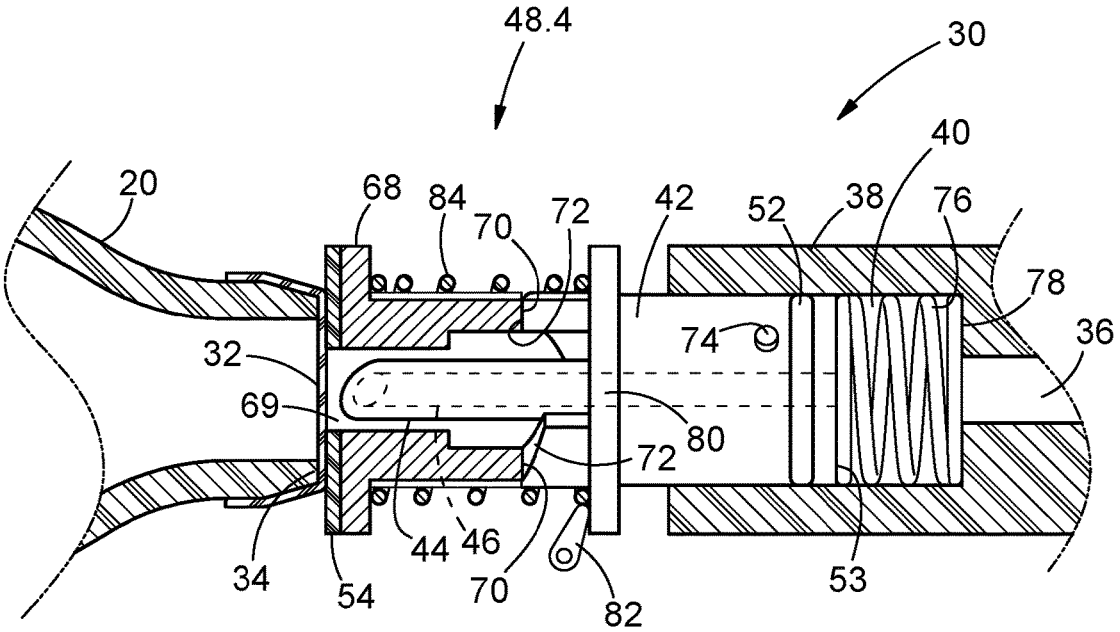
FIG. 12 is the puncture mechanism of FIG. 11, wherein the cam body and displaceable body is displaced by a canister of gas as it is installed into the less-lethal device.

In FIG. 11, the mouth 34 of the canister 20 is pressed against the sealing formation 54, but the canister 20 is not yet in its operational position. It therefore shows the canister 20 as it is being loaded into the less-lethal device 10. In FIG. 12, the canister 20 is advanced further into the body 12 of the less-lethal device 10. The radial cam surfaces 70 are interacting with the interacting cam surfaces 72 of the displaceable body 42, attempting to cause the displaceable body 42 to pivot or rotate relative to the housing 38. However, the stop member 74 is located within the internal slot, and so the rotation of the displaceable body 42 is prevented or inhibited. Consequently, the cam body 68 and displaceable body 42 moves in unison, axially, against the bias of the first biasing means 76. The displaceable body 42 therefore advances into the inner cavity 40. No relative movement is present between the cam body 68 and the displaceable body 42.

Figure 13:
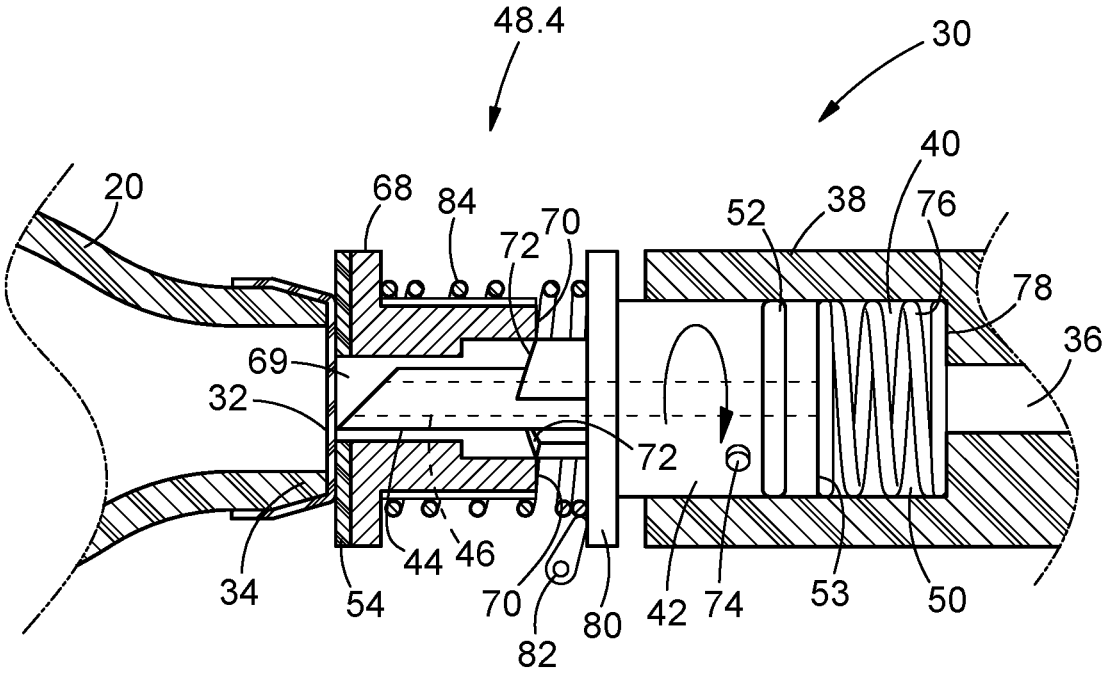
FIG. 13 is the puncture mechanism of FIG. 11, wherein the canister is in its final position, and before a trigger mechanism of the less-lethal device is actuated or pulled.

In FIG. 13, the stop member 74 has exited the internal slot, and the rotation of the displaceable body 42 is no longer prevented. Consequently, because of the interaction between the various cam surfaces, the displaceable body 42 rotates as is indicated by the arrow, until the radially disposed cam surfaces 70 and interacting cam surfaces 72 are no longer in contact. The release mechanism 82 catches the catch formation 80, and prevents the displaceable body 42 from being displaced to the second position under the bias of the first biasing means 76. The displaceable body 42 is now in a "loaded" configuration, and the canister 20 is in its final position, and locked as such by the locking cap 22.

Figure 14:
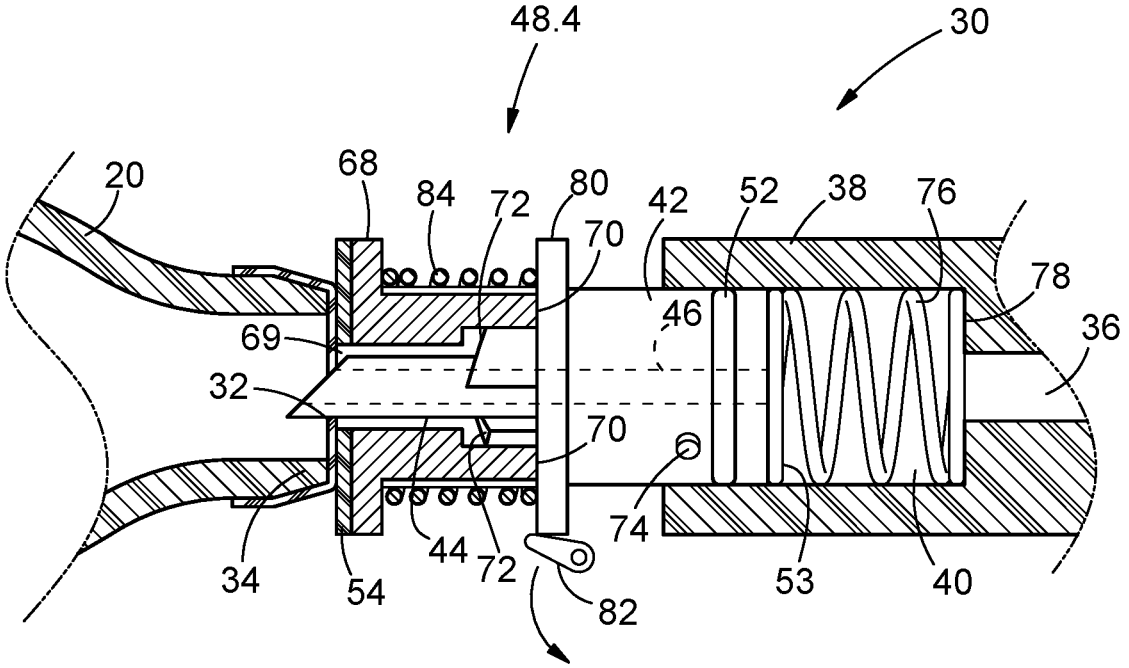
FIG. 14 is the puncture mechanism of FIG. 13, after the trigger mechanism has been actuated or pulled by a user.

Upon the next pulling of the trigger mechanism 26, the release mechanism 82 will move out of the way of the catch formation 80, as is shown in FIG. 14, and the displaceable body 42 will be displaced towards the second position, under the bias of the biasing means 76 to puncture the seal 32.

A second biasing means 84 is provided for biasing the cam body 68 and the displaceable body 42 away from each other so that when the canister 20 is spent and removed, the cam body 68 and displaceable body 42 may return to the configuration of FIG. 11. Both the first and second biasing means (76, 84) may be coil springs. Furthermore, a torsion member such as a torsion spring (not shown) may be provided for rotating the displaceable body 42 back to the configuration of FIG. 11, after the second biasing means 84 has displaced the cam body 68 and displaceable body 42 away from each other.

Again, the first pulling of the trigger mechanism 26 will cause the seal 32 to be punctured whilst also causing the release valve 24 to vent the predetermined volume of pressurised gas to propel the projectile from the barrel 16, as will be described in more detail below. It will be appreciated that the cam body 68 and the displaceable body 42 will remain in their respective positions of FIG. 14, after the initial pulling of the trigger mechanism 26, and as long as the canister 20 remains in situ.

Figure 15:
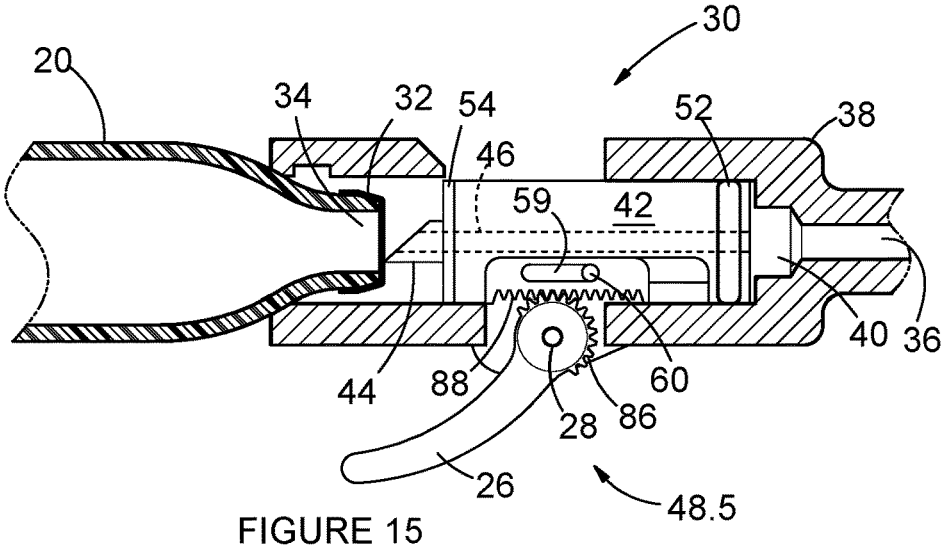
FIG. 15 is a puncture mechanism incorporating a fifth example embodiment of an actuation arrangement according to the invention, wherein a displaceable body is located in a first position.
Figure 16:
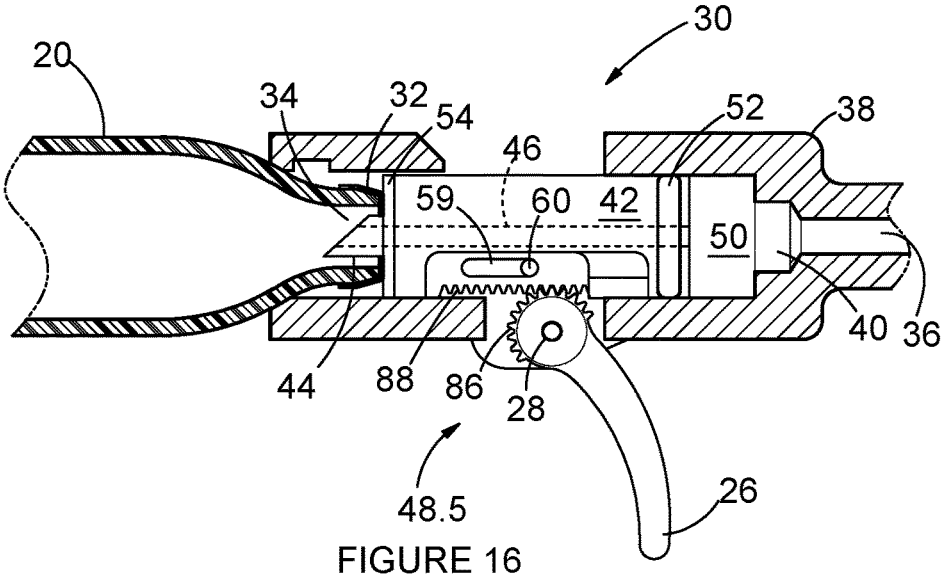
FIG. 16 is the puncture mechanism of FIG. 15, with the displaceable body in a second position, and wherein a trigger mechanism is actuated or pulled by a user.
Figure 17:
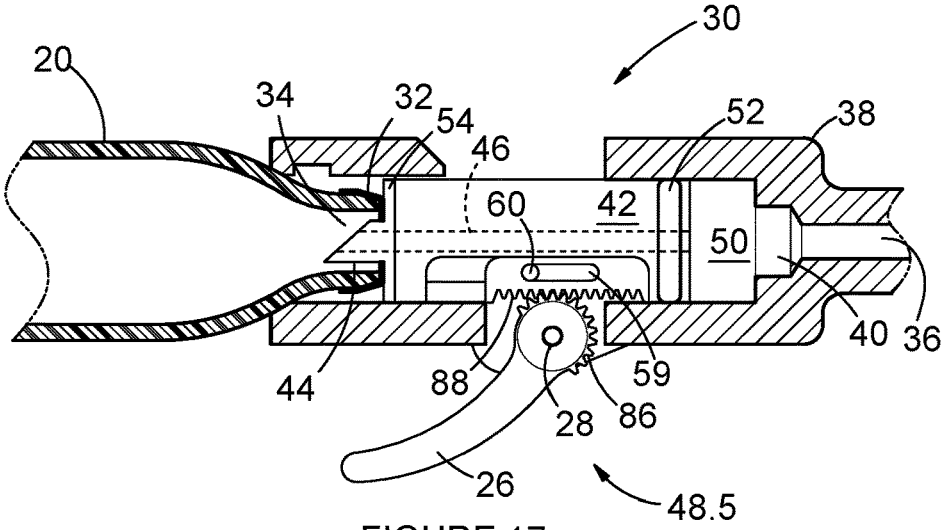
FIG. 17 is the puncture mechanism of FIG. 15 after the trigger has been released.
Figure 18:
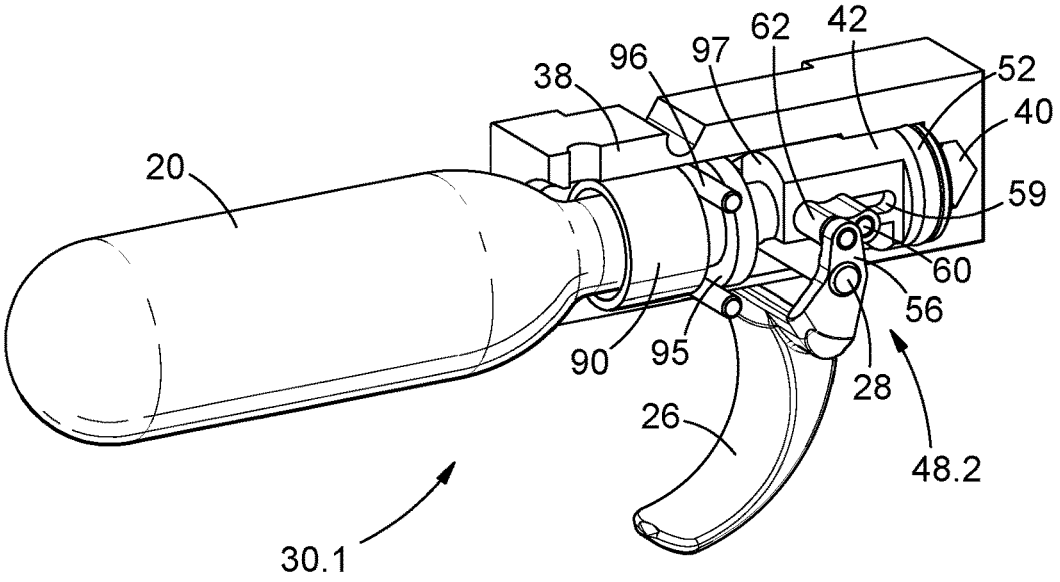
FIG. 18 is a perspective view of an alternative, and preferred embodiment of a puncture mechanism, of which certain body panels have been removed to render internal components thereof visible, which puncture mechanism incorporates a sealing body.
Figure 19:
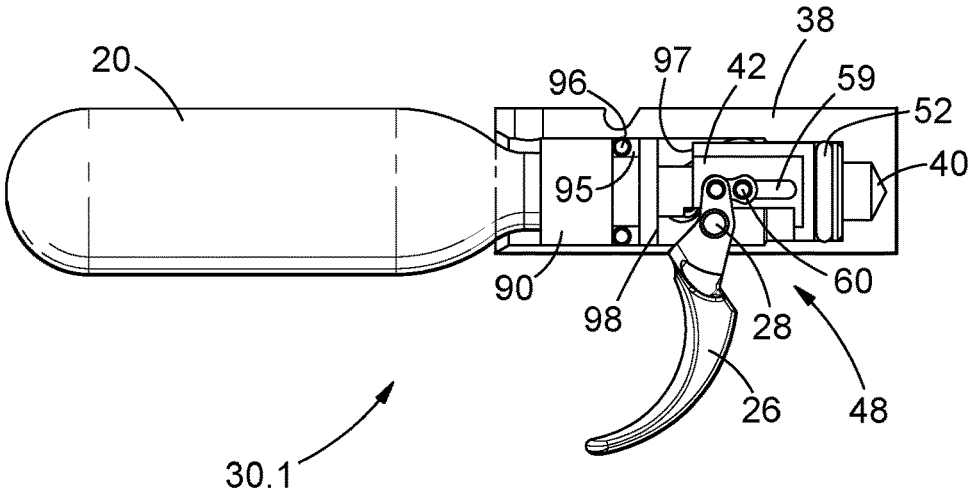
FIG. 19 is a side view of the puncture mechanism of FIG. 18.
Figure 20:
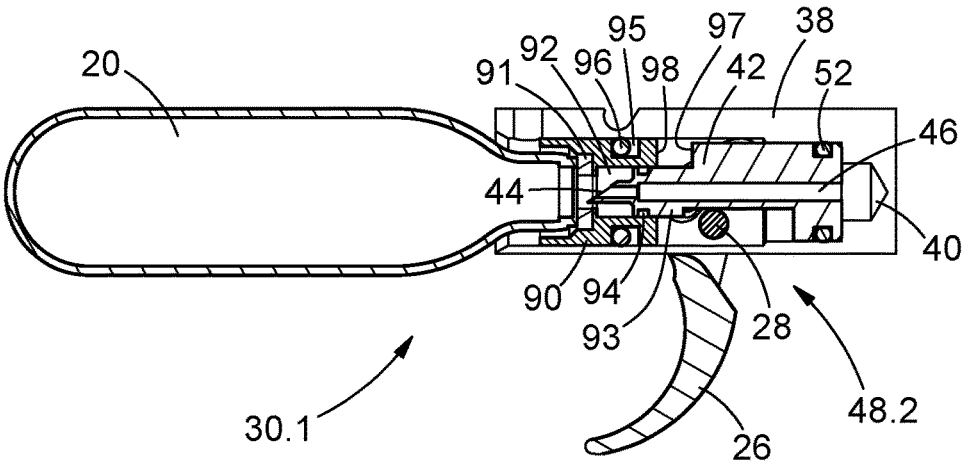
FIG. 20 is a sectioned side view of the puncture mechanism of FIG. 18.
Figure 21:
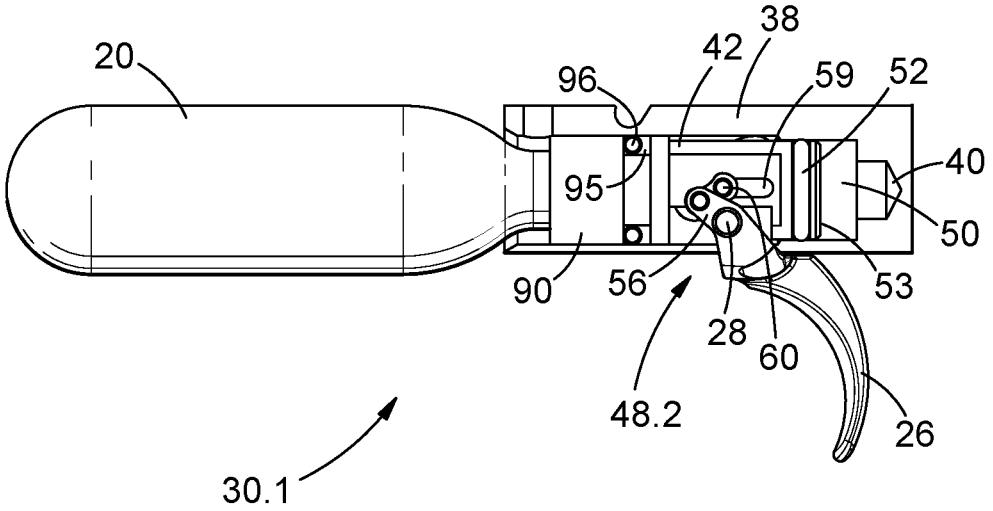
FIG. 21 is a side view of the puncture mechanism of FIG. 19, after the trigger mechanism has been pulled or actuated by the user.

A fifth example actuation arrangement 48.5 is shown in FIGS. 15 to 17. The actuation arrangement 48.5 comprises a plurality of cogs formed on the trigger mechanism 26, to resemble a pinion gear 86. A rack 88 is arranged relative to the displaceable body 42, and arranged to interact with the cogs of the pinion 86 when the displaceable body 42 is in the first position. The rack comprises a slot 59. A projection, such as a pin 60, is received within the slot 59.

When the trigger mechanism 26 is pulled, the cogs interact with the rack 88, so that an extremity of the slot 59 urges against the projection 60, thereby to displace the displaceable body 42 to the second position. Since the pin 60 is free to move within to the slot 59, the displaceable body 42 remains in the second position when the trigger mechanism 26 is released, even though the rack 88 is displaced relative to the displaceable body 42 (as is shown in FIG. 17).

Another, and preferred example puncture mechanism 30.1, is shown in FIGS. 18 to 24.

The puncture mechanism 30.1 of FIGS. 18 to 24 is compatible with canisters 20 of different lengths, and differs from the puncture mechanisms 30 described above, in that the puncture mechanism 30.1 furthermore comprises a sealing body 90, received within the housing 38. Therefore, in the case of puncture mechanism 30.1, the displaceable body 42 does not include a sealing formation 54.

The sealing body 90 is displaceable between a forward position relative to the housing 38, and a rearward position relative to the housing 38. The sealing body 90 comprises an annular seal 91 which operatively seals against the mouth 34 of the canister 20. As is discussed in more detail below, the displacement of the sealing body 90, albeit limited in extent, improves sealing against the mouth 34 of the canister 20.

Figure 22:
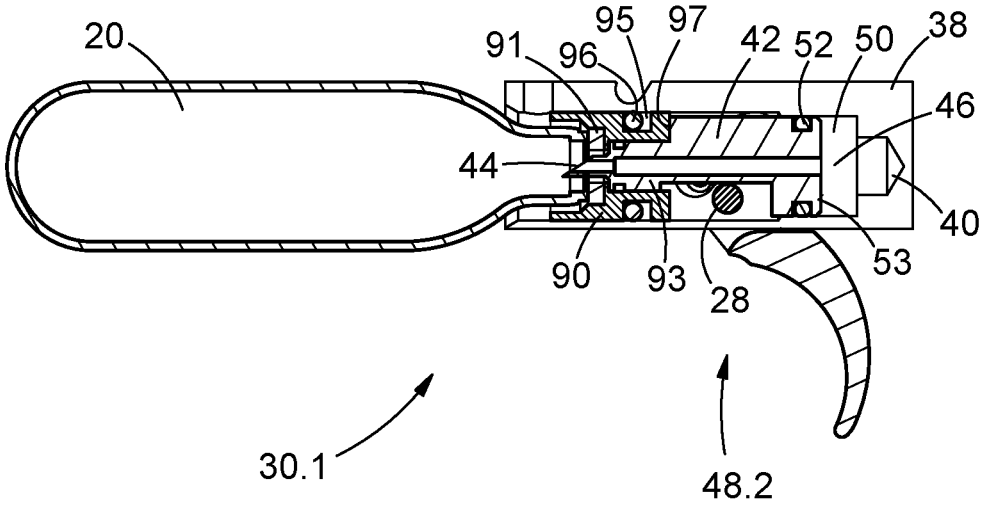
FIG. 22 is a sectioned side view of the puncture mechanism of FIG. 21.
Figure 23:
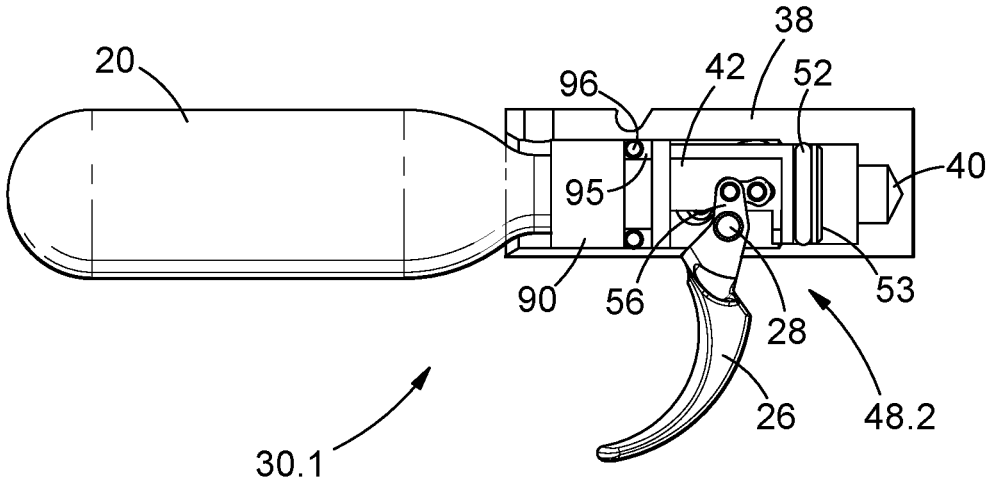
FIG. 23 is a side view of the puncture mechanism of FIG. 18, after the trigger mechanism has been released by a user.
Figure 24:
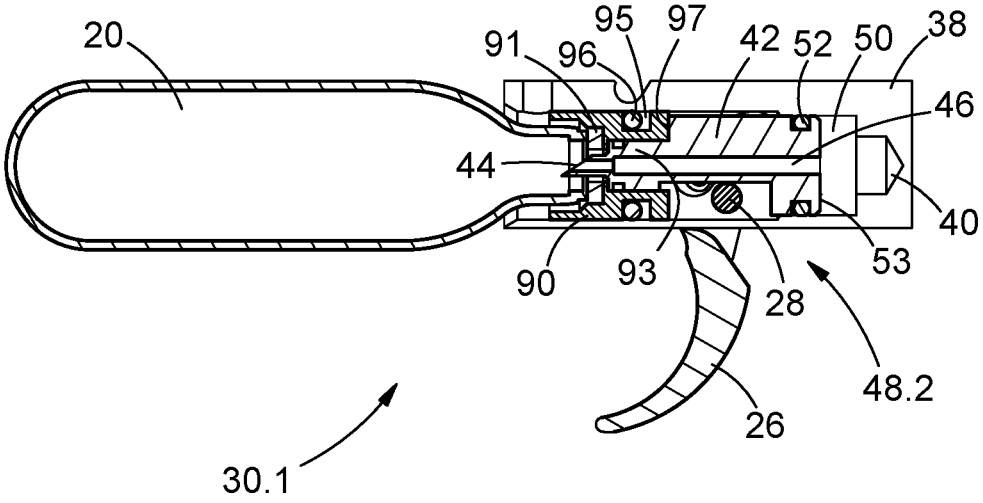
FIG. 24 is a sectioned side view of the puncture mechanism of FIG. 23.

An internal bore 92 (best shown in FIG. 20) is formed within the sealing body 90. A leading portion 93 of the displaceable body 42 (which is indicated in FIG. 22) is received within the internal bore 92. The displaceable body 42 is displaceable relative to both the housing 38 and the sealing body 90. A seal 94 is provided between the leading portion 93 and the internal bore 92 for inhibiting compressed gas from escaping therebetween. The sealing body 90 comprises a peripheral slot 95 in which a stopper 96 (typically in the form of a dowel pin as shown) is received. The stopper 96 limits the axial displacement of the sealing body 90 relative to the housing 38.

The displaceable body 42 comprises a shoulder 97. When the displaceable body 42 is in the second position, the shoulder 97 urges against a rear surface 98 of the sealing body 90, thereby improving the contact between the mouth 34 and the annular seal 91. It will be remembered that, when the displaceable body 42 is in the second position, gas pressure within the chamber 50 exerts a force on the rear surface 53. This force is therefore effectively translated to via the annular seal 91 to the mouth 34.

The puncture mechanism 30.1 of FIGS. 18 to 24 comprises a similar actuation arrangement 48.2 as the second example actuation arrangement 48 shown in FIGS. 5 to 7, with the exception that the link member 62 is pulled by the extension member 56, and the slot 59 does not extend all the way through the displaceable body 42. Therefore, two slots 59 are arranged on opposite sides of the displaceable body 42 with two pins 60 protruding into the slots 59 without extending through the displaceable body 42. Again, the displaceable body 42 will remain in the second position, even when the trigger mechanism 26 is released, as the pins 60 are free to move within the slots 59.

When the canister 20 is inserted into the body 12 of the device 10, the mouth 34 contacts the annular seal 91 before the seal 32 is punctured. The sealing body 90 is urged by the canister 20 to the rearward position. When the trigger mechanism 26 is actuated, as described above, the piercing member or mechanism 44 pierces the seal 32 and the chamber 50 is pressurised. Since the sealing body 90 is displaceable to the forwards position, the force exerted by the annular seal 91 on the mouth 34 will be constant, irrespective of the size of the canister 20. In this way a better seal is created with the mouth 34 of the canister 20.

The locking cap 22 may furthermore comprises a spring (not shown), to ensure that canisters 20 of different lengths always make proper contact with the annular seal 91.

It will be understood throughout this disclosure, where a first body comprises a slot and a second body comprises a pin or projection that interact with the slot, or that extends into the slot, the invention similarly extends to an arrangement where the first body comprises the pin or projection, and the second body comprises the slot, unless otherwise stated.

As was stated before, an initial pulling of the trigger mechanism 26 causes the canister 20 to be punctured and a first projectile to be propelled from the barrel 16. This is made possible by a propelling assembly, which is generally designated by reference numeral 100 in FIGS. 25 to 27. The propelling assembly 100 comprises the release valve 24 and a pressure sensitive/sensing/responsive activation assembly 102.

Figure 25:
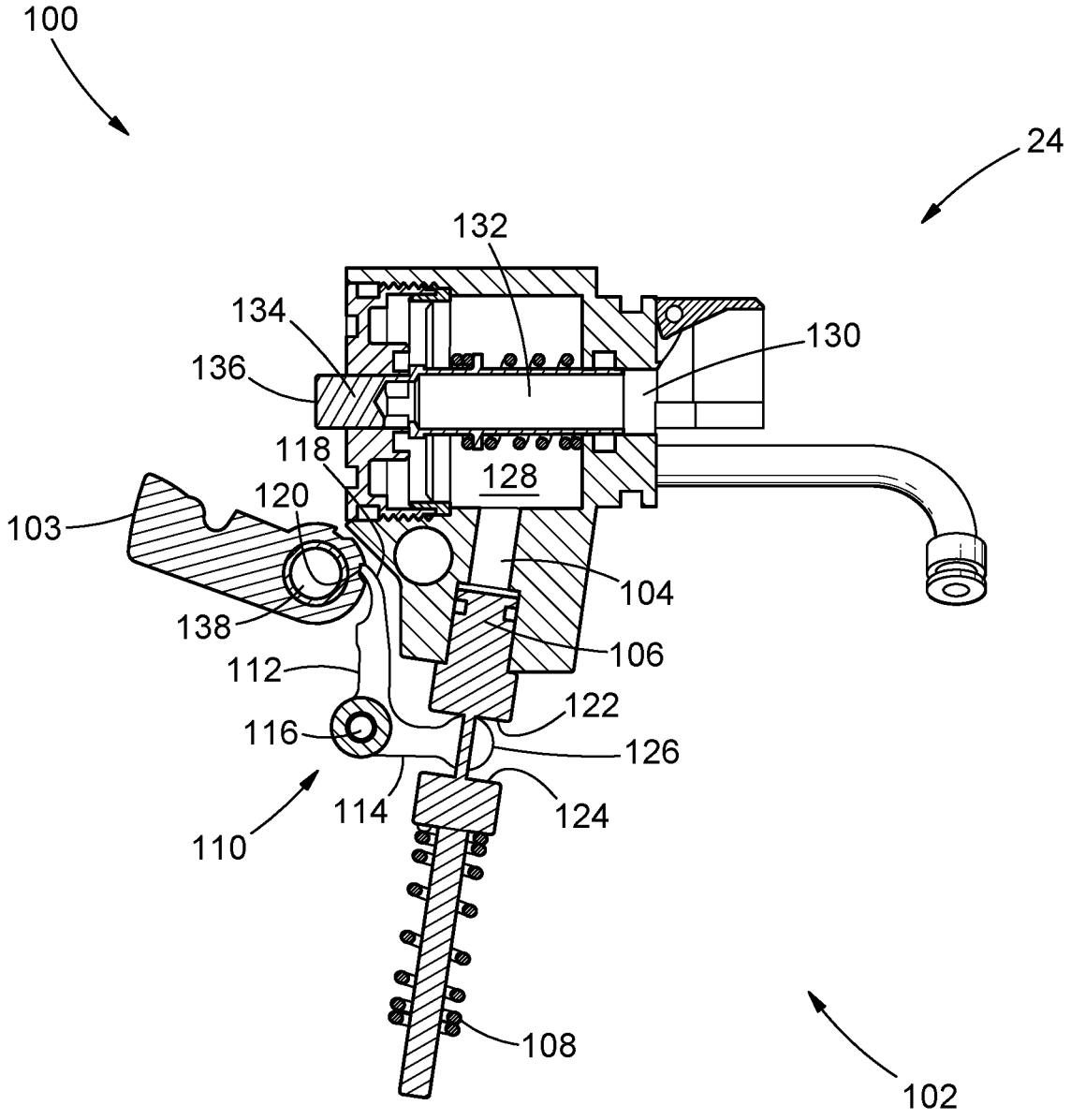
FIG. 25 is a propelling assembly according to the invention, wherein a hammer is located in a cocked position, and wherein a locking member is in a first configuration.

The pressure sensitive activation assembly 102 (which in some respects corresponds with a conventional "sear" of a firearm), is used to inhibit a hammer (or cock) 103 associated with the release valve 24 from being activated before a predetermined pressure is reached within the release valve 24 (as is discussed more fully below). The pressure sensitive activation assembly 102 comprises a chamber 104 which receives pressurised gas in use, from the canister 20, after being punctured as described above. A piston 106 is received within the chamber 104, and is displaceable between a first position (as shown in FIG. 25) and a second position (as shown in FIGS. 26 and 27) within the chamber 104.

A biasing means in the form of a spring 108 is used to bias the piston 106 towards the first position. The spring 108 has a spring constant or stiffness, which imparts a bias that requires a predetermined minimum force to be overcome. Therefore, a predetermined force needs to be exerted on the piston 106 to overcome the bias of the spring 108 and cause the piston 106 to be displaced to the second position. A predetermined pressure within the chamber 104 corresponds with the predetermined force required to cause the piston 106 to overcome the bias. This pressure is typically around 600 psi, but may vary or be changed based on user or operational requirements.

Figure 26:
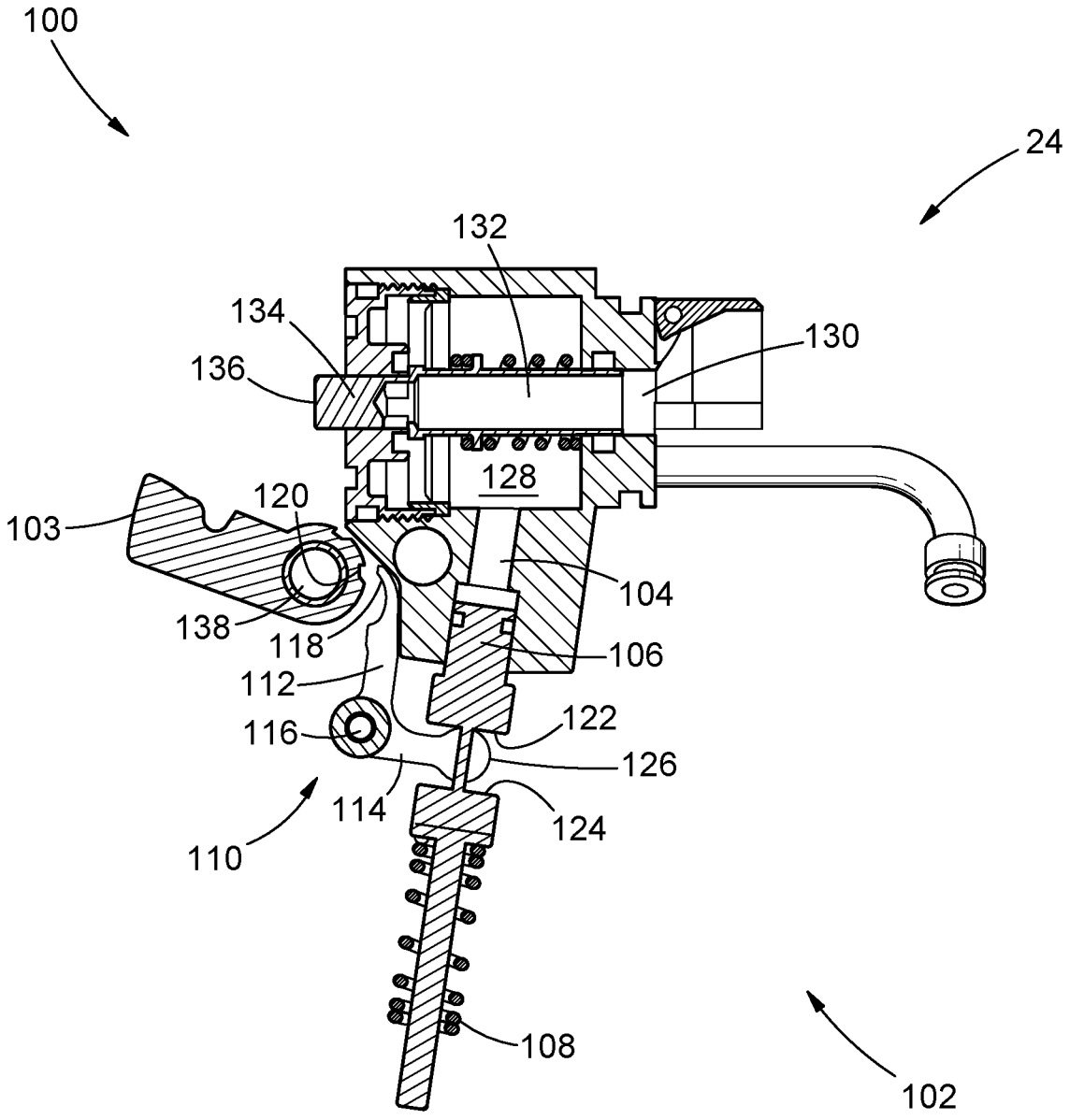
FIG. 26 is the propelling assembly of FIG. 25 wherein the hammer is still located in a cocked position, but wherein the locking member is in a second configuration.
Figure 27:
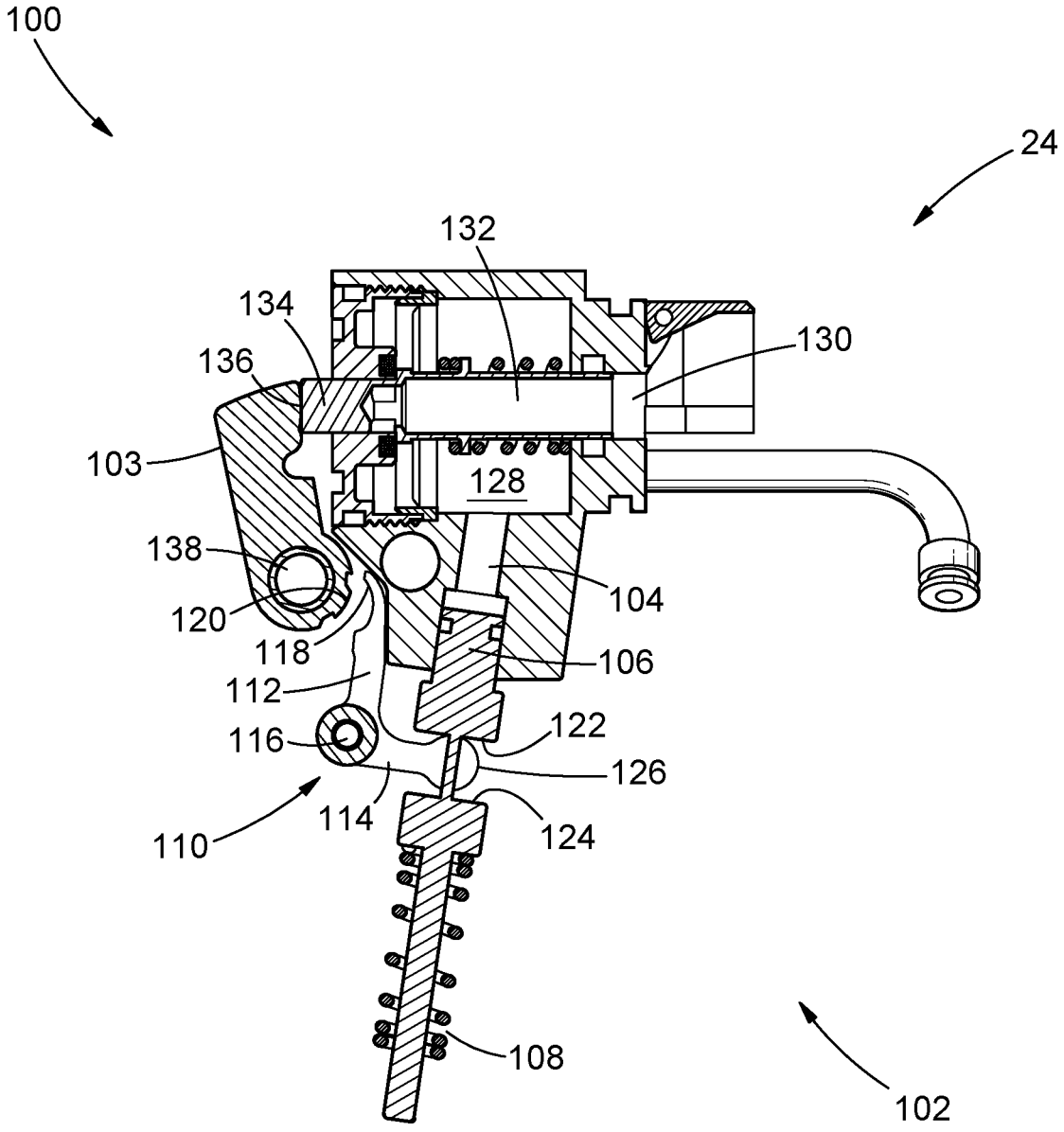
FIG. 27 is the propelling assembly of FIG. 25 wherein the hammer is located in an un-cocked position, and wherein the locking member is in the second configuration.

The pressure sensitive activation assembly 102 furthermore comprises a locking member 110 which is displaceable between a first configuration (shown in FIG. 25) and a second configuration (shown in FIGS. 26 and 27).

The locking member 110 comprises a first arm 112 and a second arm 114 which are disposed at a predetermined angle, such as a right angle, so that the locking member 110 is substantially L-shaped, as shown. The locking member 110 is fixed relative to the release valve 24 via a hinge 116. The locking member 110 therefore pivots between the first and second configurations.

A catch formation 118 is formed on an extremity of the first arm 112 and is provided to interact with a shoulder 120 formed on the hammer 103. When the locking member 110 is in the first configuration (and the hammer 103 is in a cocked position), the catch formation 118 and the shoulder 120 interacts and the hammer 103 is thereby inhibited from pivoting towards the release valve 24. When the locking member 110 is however displaced to the second configuration, the catch formation 118 moves away from the shoulder 120, so that the hammer 103 is free to pivot towards the release valve 24 and thereby actuate the release valve 24.

The piston 106 comprises a first shoulder 122 and second shoulder 124. The second arm 114 has a formation 126 which is arranged between the first and second shoulders (122, 124) and in sliding contact with the first and second shoulders (122, 124). Therefore, when the piston 106 is displaced from the first position to the second position, the locking member 110 is pivoted from the first configuration to the second configuration. Also, when the piston 106 is displaced from the second position back to the first position, the locking mechanism 110 is pivoted from the second configuration back to the first configuration.

The spring 108 is adjustable so that the minimum gas pressure that would cause the piston 106 to overcome the bias can be adjusted according to operational requirements.

The release valve 24 comprises a holding chamber 128 which is provided in fluid flow communication with the pressure tube 36, and the chamber 104 of the pressure sensitive activation assembly 102.

Therefore, once the canister 20 is punctured, as described above, compressed gas is received and contained within the holding chamber 128. The holding chamber 128 comprises an outlet 130 into the barrel 16.

The release valve 24 furthermore comprises a valve pin 132 which is displaceable between a closed position wherein the outlet 130 is sealed or closed, so that compressed gas within the holding chamber 128 is inhibited from escaping through the outlet 130, and an open position, wherein compressed gas from within the holding chamber 128 is allowed to vent or escape through the outlet 130. The valve pin 132 is biased towards the closed position by a biasing means.

A striker 134 having a striking surface 136 is arranged in contact with the valve pin 132. It will be appreciated that the striker 134 and valve pin 132 may alternatively be integrally formed. The striker is arranged so that the hammer 103, when actuated, strikes the striking surface 136, thereby causing the valve pin 132 to be displaced to the open position.

The hammer 103 is fixed relative to the striking surface 136 by a hinge 138 and can pivot between a cocked position (shown in FIGS. 25 and 26) and an un-cocked position (shown in FIG. 27).

The hammer 103 comprises a cocking shoulder (not shown) with a trigger release mechanism (not shown) which interacts with the cocking shoulder for holding the hammer in the cocked position, against the bias of the torsional spring. When the trigger mechanism 26 is actuated, the trigger release mechanism moves away from the cocking shoulder, and the hammer 103 is allowed to strike the striking surface 136 under the influence of a torsion spring 140.

The release valve 24 comprises various internal seals to prevent compressed gas from escaping from the holding chamber 128 between the striker 134 and an outside atmosphere, or between the valve pin 132 and the barrel 16.

Figure 28:
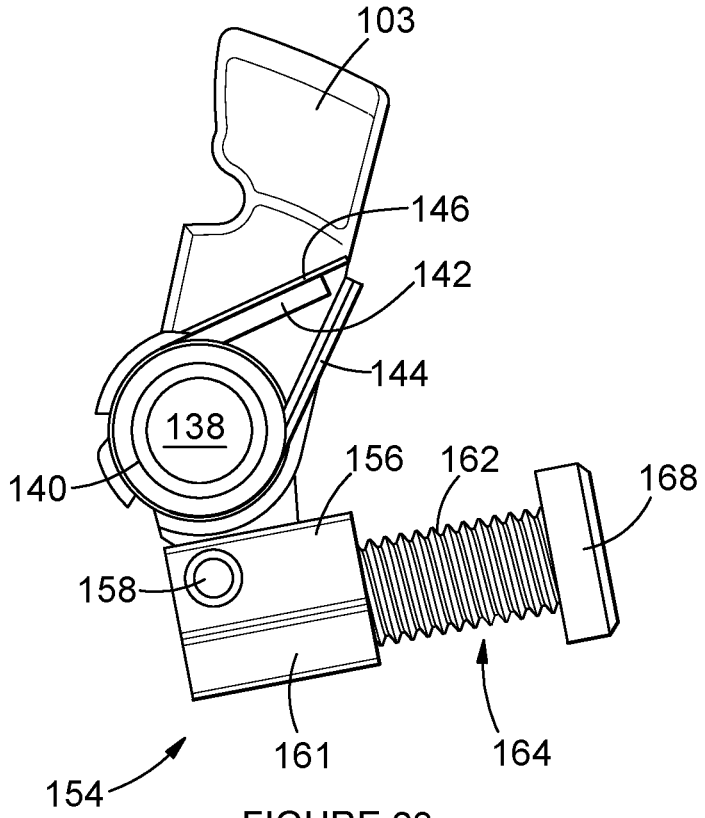
FIG. 28 is a side view of a tension adjusting mechanism, of which certain components have been omitted to render internal components visible.

The torsion spring 140 (which is best shown in FIG. 28) urges the hammer 103 to the un-cocked position. The torsion spring 140 is arranged about the hinge 138. The torsion spring 140 comprises a first and second arm (142, 144). At rest, the first and second arms (142, 144) are disposed relative to each other at a "free angle", and no resultant force (or bias) is exerted between the first and second arms (142, 144).

The hammer 103 comprises a shoulder 146, against which the first arm 142 urges. Therefore, when the hammer 103 is moved towards the cocked position, the first arm 142 exerts a force on the shoulder 146, thereby to urge the hammer towards the un-cocked position.

The kinetic force with which the striking surface 136 is struck by the hammer 103 is adjustable, thereby to adjust the volume of gas escaping through the outlet. A tension adjusting mechanism 148 is provided for this purpose. By striking the striking surface 136 with more kinetic energy, the valve pin 132 is kept in the open position for longer, and a larger volume of compressed gas is vented or released from the holding chamber 128 through the outlet 130.

Figure 29:
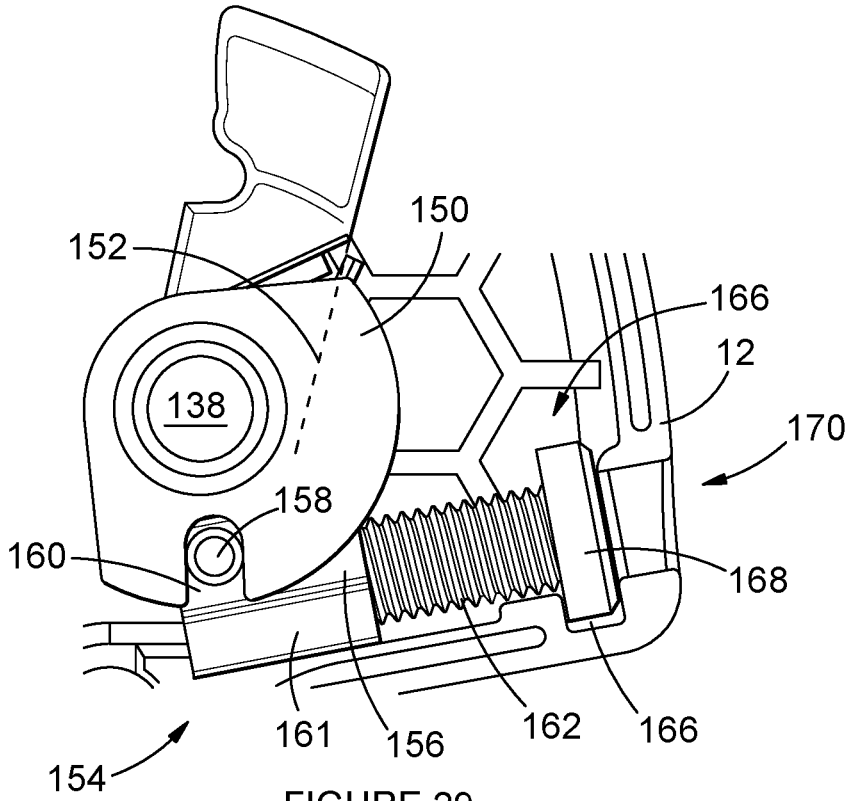
FIG. 29 is a side view of the tension adjusting mechanism of FIG. 28 in situ, with an adjusting body in a forward position.
Figure 30:
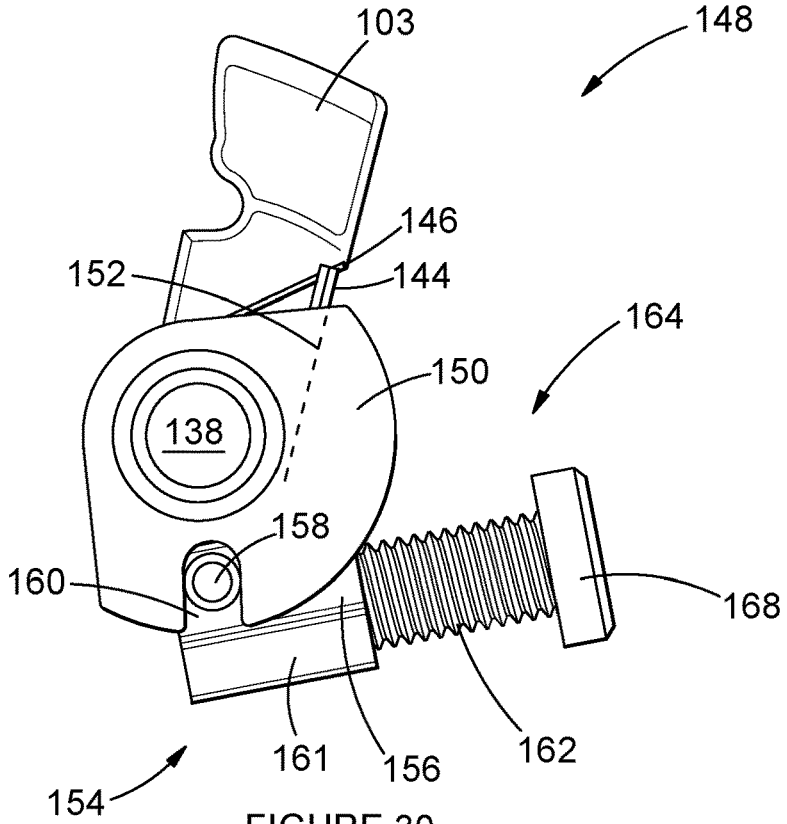
FIG. 30 is a side view of the tension adjusting mechanism of FIG. 28, with an adjusting body in a forward position.
Figure 31:
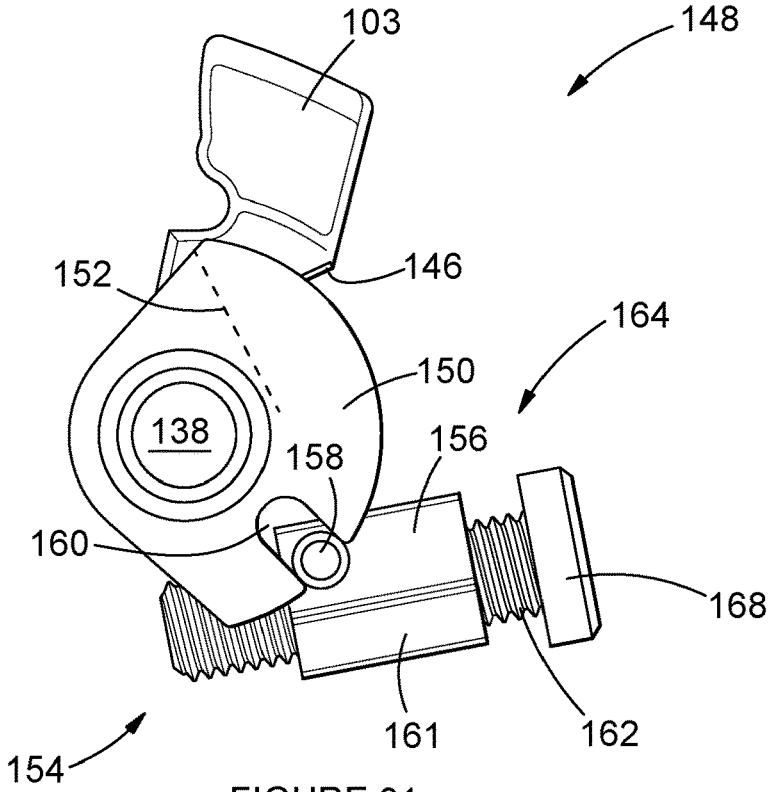
FIG. 31 is a side view of the tension adjusting mechanism of FIG. 28, with the adjusting body in a rearward position.

As is best illustrated in FIGS. 29 to 31, the tension adjusting mechanism 148 comprises a follower body 150 which defines a shoulder 152 against which the second arm 144 of the torsion spring 140 urges in use. The tension adjusting mechanism 148 furthermore comprises an adjustor 154 which is used to adjust the follower body 150 by pivoting the follower body 150 about the hinge 138. Pivoting of the follower body 150 causes the first and second arms (142, 144) to pivot relative to each other, thereby adjusting the resultant force exerted between the first and second arms (142, 144).

The follower body 150 is fitted to pivot about the hinge 138. The adjustor 154 comprises an adjusting body 156 which can slide relative to the body 12 of the device 10. Internal grooves (not shown) are provided within the body 12, in which shoulders 161 of the adjusting body 156 slide, so that the adjusting body 156 may slide between a first (forwards) position (as is shown in FIGS. 28 to 30) and a second (rearwards) position (as is shown in FIG. 31). A protuberance, in the form of pin 158 extends from the adjusting body 156. The pin 158 is received within a slot 160, which is formed on the follower body 150. The pin 158 and the slot 160 together constitutes a linear cam arrangement.

When the adjusting body 156 is displaced from the first to the second positions, the first and second arms (142, 144) of the torsion spring 140 is adjusted relative to each other. The adjusting body 156 furthermore comprises a tapped hole (not shown). A shank 162 of an adjustment screw 164 is received within the tapped hole. When the adjustment screw 164 is rotated, screw threads of the shank 162 and the tapped hole interact so that the adjusting body 156 is displaced between the first to the second positions.

The body 12 comprises a slot 166 (best shown in FIG. 29) in which a head 168 of the adjustment screw 164 is located, so that the head 168 is inhibited from being axially displaced relative to the body 12. The body 12 also defines a hole 170 (also shown in FIG. 29) proximate the head 168 of the adjustment screw 164, for receiving the head of an adjustment tool, such as a screw driver therethrough.

Therefore, when the adjustment screw 164 is rotated, the adjusting body 156 is moved, so that the resultant force between the first and second arms (142, 144) is adjusted.

In use, a canister 20 is inserted or installed into position within the body 12 of the less-lethal device 10 as described previously. A projectile (not shown) is advanced into a breech of the barrel 16. Since the canister 20 is not yet punctured, the chamber 104 is at atmospheric pressure, or at least below the predetermined pressure, and the piston 106 is in the first position. Consequently, locking member 110 is in the first configuration so that the catch formation 118 interacts with the shoulder 120. It will be appreciated that the hammer 103 will only be able to strike the striking surface 136 once the locking member 110 is displaced to the second configuration, and the trigger release mechanism moves away from the cocking shoulder. The hammer is cocked, which means that the trigger release mechanism interacts with the cocking shoulder.

Once the trigger mechanism 26 is actuated or pulled by a user, the canister 20 is punctured as previously described and compressed gas flows through the pressure tube 36 into the holding chamber 128. Simultaneously, the trigger release mechanism moves away from the cocking shoulder. As soon as enough pressure builds up within the holding chamber 128, and thus the predetermined pressure is reached within the chamber 104, the locking member 110 is displaced to the second configuration, the catch formation 118 moves away from the shoulder 120, and the hammer 103, under the bias of the torsion spring 140 strikes the striking surface 136, so that the valve pin 132 moves to the open position, allowing the predetermined volume of compressed gas to vent through the outlet 130 into the barrel 16. The volume of compressed gas venting into the barrel 16 propels the projectile from the barrel 16.

As long as the pressure provided from the canister 20 remains above the predetermined pressure, the locking member 110 will remain in the second configuration. When the trigger mechanism 26 is released, and after the projectile is propelled, the hammer is returned to the cocked position, and a subsequent projectile is received within the breech. A subsequent pulling of the trigger mechanism 26 will again cause to the trigger release mechanism to move away from the cocking shoulder, which will allow the hammer 103 to strike the striking surface 136 (since the locking member 110 is still in the second configuration), thereby causing the second projectile to be propelled from the barrel 16.

Provided that enough projectiles are available in the magazine 18, the above process may be repeated until the pressure of gas provided by the canister 20 drops below the predetermined pressure required to keep the locking member 110 in the second configuration, after which the canister 20 may be discarded. The above steps will be repeated when loading a new canister 20 into the device 10.

Since the puncture mechanism 30 comprises the bore 46, compressed gas can immediately after the seal 32 is punctured, flow from the canister 20 to the release valve 24. This together with the use of the pressure sensitive activation assembly 102 enables the puncturing of the canister 20 and the propelling of a projectile with a single pull of the trigger mechanism 26, which prevents undue delays during emergency situations. Also, since the displaceable body 42 remains in the second position when the trigger mechanism 26 is released after the initial pull, the sensitivity of the trigger mechanism 26 is not lost. Furthermore, the specific configuration of the propelling assembly 100 is compact and ensure that the device 10 is compact and ergonomically friendly. The pressure sensitive activation assembly 102 furthermore ensures that an adequate pressure is reached within the release valve 24 before the first projectile is propelled from the barrel 16, to ensure that the projectile is propelled at an adequate velocity.

It will be appreciated by those skilled in the art that the invention is not limited to the precise details as described herein and that many variations are possible without departing from the scope and spirit of the invention.

The description above is presented in the cause of providing what is believed to be the most useful and readily understandable description of the principles and conceptual aspects of the invention. In this regard, no attempt is made to show structural details of the invention in more detail than necessary for a fundamental understanding of the invention. The words used should therefore be interpreted as words of description rather than words of limitation.

The invention claimed is:

1. A puncture mechanism for puncturing a seal provided over a mouth of a canister of compressed gas operatively received within a body of a less-lethal device, the puncture mechanism comprising:

a housing defining an internal cavity;

a displaceable body received within the internal cavity and sealingly within the housing, the displaceable body having a piercing mechanism and an internal bore which extends from the piercing mechanism through the displaceable body;

a chamber defined between an inner surface of the housing and a rear end of the displaceable body which is in fluid flow communication with the internal bore of the displaceable body; and an actuation arrangement for displacing the displaceable body from a first position operatively spaced from a canister, to a second position towards the canister, the actuation arrangement comprising a trigger mechanism such that when the displaceable body is located in the first position and the trigger mechanism is operatively actuated the displaceable body is displaced towards the second position wherein the piercing mechanism pierces a seal of the canister and compressed gas flows from the canister through the internal bore towards the chamber, and when the trigger mechanism is released the actuation arrangement is released from the displaceable body and the displaceable body is kept in the second position due to compressed gas received within the chamber.

2. The puncture mechanism of claim 1, wherein the chamber is in fluid flow communication with a valve assembly serving to operatively vent a predetermined volume of compressed gas to propel a projectile from a barrel of the less-lethal device, wherein the valve assembly comprises:

a holding chamber for operatively receiving and containing pressurized gas from the canister, the holding chamber comprising an outlet for releasing gas into a barrel to propel a projectile;

a valve pin displaceable between a closed position wherein the outlet of the holding chamber is sealed, and an open position, wherein compressed gas is allowed to escape from the holding chamber into the barrel;

a hammer displaceable between a cocked and an uncocked position and arranged to strike a striking surface to displace the valve pin to the open position when the trigger mechanism is actuated; and a locking member displaceable between a first configuration, wherein the pressure inside the holding chamber is not at a predetermined pressure and the locking member interacts with the hammer to inhibit the hammer from strike the striking surface, and a second configuration wherein the locking member does not interact with the hammer allowing the hammer to strike the striking surface to displace the valve pin to the open position when the trigger mechanism is actuated.

3. The puncture mechanism of claim 2, wherein the rear end of the displaceable body includes a surface whereupon compressed gas within the chamber acts to urge the displaceable body towards the second position.

4. The puncture mechanism of claim 3, wherein the displaceable body includes a peripheral seal which is received within a peripheral groove, the peripheral seal serving to seal the housing to inhibit compressed gas from escaping between the housing and the displaceable body.

5. The puncture mechanism of claim 1, wherein the actuation arrangement comprises:

an extension member of the trigger mechanism, the extension member freely movable in a slot in the displaceable body when the trigger mechanism is operatively actuated and released; and a contact surface formed on the displaceable body, the arrangement being such that when the displaceable body is located in the first position and the trigger mechanism is actuated by a user, the extension member urges against the contact surface thereby to cause the displaceable body to be displaced to the second position, and so that when the trigger mechanism is released by the user, the extension member moves away from the contact surface, so that the displaceable body remains in the second position.

6. The puncture mechanism of claim 1, wherein the actuation arrangement comprises:

an extension member of the trigger mechanism;

an actuation pin received within a slot extending in the displaceable body; and a link member hingedly connected to the extension member and extending to the actuation pin, the arrangement being such that when the displaceable body is located in the first position and the trigger mechanism is actuated by a user, the link member urges the actuation pin against a front end of the slot thereby to cause the displaceable body to be displaced to the second position, and so that when the trigger mechanism is released by the user, the actuation pin moves away from the front end, so that the displaceable body remains in the second position.

7. The puncture mechanism of claim 1, wherein the actuation arrangement comprises:

an extension member of the trigger mechanism; and an actuation pin extending from the extension member into a slot extending in the displaceable body, wherein a size of the slot exceeds a size of the actuation pin, and wherein the arrangement is such that when the displaceable body is located in the first position and the trigger mechanism is actuated by a user, the extension member urges the actuation pin against a front end of the slot thereby to cause the displaceable body to be displaced to the second position, and so that when the trigger mechanism is released by the user, the actuation pin moves away from the front end, so that the displaceable body remains in the second position.

8. The puncture mechanism of claim 1, wherein the actuation arrangement comprises:

at least one radially disposed cam surface formed on a cam body provided with an annular seal for sealing against the mouth of the canister, the cam body defining an axial bore;

at least one interacting cam surface formed on the displaceable body for interacting with the radially disposed cam surface of the cam body, wherein the piercing mechanism projects in the axial bore of the cam body;

a stop member formed on the displaceable body, receivable within an internal slot formed on the housing, so that when the stop member is received within the internal slot, the displaceable body is prevented from articulating relative to the housing;

a catch formation formed on the displaceable body for catching on a release mechanism;

a biasing means for biasing the displaceable body towards the second position, and a second biasing means for biasing the cam body and the displaceable body away from each other.

9. The puncture mechanism of claim 1, wherein the actuation arrangement comprises:

a plurality of cogs formed on the trigger mechanism;

a rack arranged relative to the displaceable body, the rack comprising a slot which operatively receives a projection projecting from the displaceable body, wherein the rack is arranged to interact with the cogs; and when the displaceable body is located in the first position and the trigger mechanism is actuated by a user, the plurality of cogs interact with the rack, thereby to urge the displaceable body to the second position, and wherein the projection is displaceable within a slot, so that the displaceable body remains in the second position when the trigger mechanism is released.

10. The puncture mechanism of claim 1, wherein the housing includes a receiving formation for operatively receiving the canister with the displaceable body comprising a sealing formation adapted for sealing against the mouth of the canister.

11. The puncture mechanism of claim 1, wherein the puncture mechanism further comprises a sealing body which is received within the housing, the sealing body comprising the internal bore for receiving a leading portion of the displaceable body and displaceable between a forward and a rearward position relative to the housing, the sealing body comprising an annular seal which operatively seals against a mouth of the canister.

12. The puncture mechanism of claim 11, wherein a seal is provided between the leading portion of the displaceable body and the internal cavity for operatively preventing compressed gas from leaking between the displaceable body and the sealing body.

13. The puncture mechanism of claim 2, wherein the trigger mechanism is configured to displace the valve pin of the valve assembly to an open position when the trigger is operatively actuated thereby allowing a predetermined volume of compressed gas to be released from the valve assembly to propel the projectile from a barrel of the less-lethal device.

* * * * *